US006089305A

United States Patent [19]

Gruben et al.

[11] Patent Number: 6,089,305

[45] Date of Patent: Jul. 18, 2000

[54] CURTAIN GUIDING ASSEMBLY FOR A SOFT EDGE DOOR WITH A SELECTIVELY TENSIONED LEADING EDGE

[75] Inventors: Wayne E. Gruben, Bellavista, Ark.; Peter S. Schulte, East Dubuque, Ill.; James P. Schwingle, Cuba City, Wis.

[73] Assignee: Rite-Hite Holding Corporation, Milwaukee, Wis.

[21] Appl. No.: 08/911,381

[22] Filed: Aug. 14, 1997

Related U.S. Application Data

[63] Continuation-in-part of application No. 08/686,995, Jul. 24, 1996, which is a continuation-in-part of application No. 08/437,853, May 9, 1995, abandoned, which is a continuation-in-part of application No. 08/386,743, Feb. 10, 1995, abandoned.

[51] Int. Cl.[7] ..... A47H 3/00

[52] U.S. Cl. ..... 160/271; 160/268.1; 160/310; 160/264

[58] Field of Search ..... 160/268.1, 270, 160/271, 272, 273.1, 265, 405, 274, 282, 284

[56] References Cited

U.S. PATENT DOCUMENTS

| | | |
|---|---|---|
| 1,033,224 | 7/1912 | Andlauer . |
| 3,878,879 | 4/1975 | Mannes . |
| 4,016,920 | 4/1977 | Shapard . |

(List continued on next page.)

FOREIGN PATENT DOCUMENTS

| | | |
|---|---|---|
| 125217 | 11/1984 | European Pat. Off. . |
| 1009862 | 6/1952 | France . |
| 240349 | 10/1925 | United Kingdom . |
| 503774 | 4/1939 | United Kingdom . |
| 1444017 | 4/1972 | United Kingdom . |

OTHER PUBLICATIONS

"*PCT International Search Report*", PCT Patent Application Serial No. PCT/US98/16988 corresponding to U.S. Serial NO. 08/911,381, dated Nov. 25, 1998, 8 pages.

"*Re–Coil–Away" Specifications* Brochure, 2 pages.

"*Re–Coil–Away*" Installation Instructions, M & I Door Systems Limited, Barrie, Ontario, Canada, 18 pages, Revised May, 1991.

"*The Near–Indestructible, Maintenance–Free Rubber Door Systems*" Brochure, M & I Door Systems Limited, Barrie, Ontario, Canada, 2 pages.

"*Fstdoor*" Brochure, M & I Door Systems Limited, Barrie, Ontario, Canada, 2 pages.

"*Rytec Breaks Away*!" Brochure, Rytec High Performance Doors, Jackson, Wisconsin, 2 pages.

"*Rapid Roll® Doors: The Super–Fast Solution*!" Brochure, Rapid Roll® Doors, 8 pages, (1990).

"*SPIRIT High Speed Roll–Up Door*" Brochure, Marathon Door Division, ASI Technologies, Inc., Milwaukee, Wisconsin, 3 pages.

"*RT Series Patented Tufflex Beam™ And Releasable Option*" Brochure, Kelley Company, Inc., Milwaukee, Wisconsin, 2 pages, (1993).

(List continued on next page.)

*Primary Examiner*—Blair M. Johnson
*Attorney, Agent, or Firm*—Marshall, O'Toole, Gerstein, Murray & Borun

[57] ABSTRACT

A curtain guiding assembly for an industrial door is disclosed. The curtain guiding assembly is provided with a resilient member disposed adjacent the leading edge of a door curtain. The resilient member is substantially untensioned when no external force is applied to the door curtain and is adapted to at least partially conform to or at least partially deflect about encountered obstacles. The resilient member becomes tensioned upon application of an external force less than a first predetermined threshold and returns to its substantially untensioned state upon removal of the external force.

52 Claims, 14 Drawing Sheets

U.S. PATENT DOCUMENTS

| | | | |
|---|---|---|---|
| 4,452,292 | 6/1984 | Leivenzon et al. . | |
| 4,478,268 | 10/1984 | Palmer . | |
| 4,569,383 | 2/1986 | Wentzel . | |
| 4,601,320 | 7/1986 | Taylor . | |
| 4,800,946 | 1/1989 | Rosenoy . | |
| 4,884,617 | 12/1989 | Coenraets . | |
| 4,887,660 | 12/1989 | Kraus . | |
| 4,896,714 | 1/1990 | Ellis . | |
| 5,025,847 | 6/1991 | Mueller . | |
| 5,048,588 | 9/1991 | Weishar et al. . | |
| 5,056,579 | 10/1991 | Krafutler . | |
| 5,078,197 | 1/1992 | Weishar . | |
| 5,123,474 | 6/1992 | Smith . | |
| 5,139,074 | 8/1992 | Warner . | |
| 5,139,075 | 8/1992 | Desrochers . | |
| 5,141,043 | 8/1992 | Krauetler . | |
| 5,141,044 | 8/1992 | Hying et al. . | |
| 5,207,256 | 5/1993 | Kraeutler . | |
| 5,219,015 | 6/1993 | Kraeutler | 160/271 |
| 5,222,541 | 6/1993 | Hornberger . | |
| 5,271,448 | 12/1993 | Delgado . | |
| 5,299,617 | 4/1994 | Hying et al. . | |
| 5,353,859 | 10/1994 | Oltahfer et al. . | |
| 5,477,902 | 12/1995 | Kraeutler . | |
| 5,526,865 | 6/1996 | Coenraets . | |
| 5,535,805 | 7/1996 | Kellogg et al. . | |
| 5,579,820 | 12/1996 | LePage et al. . | |
| 5,601,133 | 2/1997 | Krupke et al. . | |
| 5,620,039 | 4/1997 | Delgado et al. | 160/271 |
| 5,638,883 | 6/1997 | Schulte . | |
| 5,743,317 | 4/1998 | Beringer et al. | 160/10 |

OTHER PUBLICATIONS

"*KELLEY Door Selection Guide*", Kelley Company, Inc., Milwaukee, Wisconsin, 16 pages.

"*Commercial Plastics—A Case History*" Brochure, 1 page.

*International Preliminary Examination Report,* PCT Patent Application Serial No. PCT/US98/16988 corresponding to U.S. Serial No. 08/911,381, dated Sep. 21, 1999, European Patent Office, 5 pages.

CURTAIN GUIDING ASSEMBLY FOR A SOFT EDGE DOOR WITH A SELECTIVELY TENSIONED LEADING EDGE

CROSS-REFERENCE TO RELATED APPLICATIONS

This application is a continuation-in-part of application U.S. Ser. No. 08/686,995 filed Jul. 24, 1996, which is a continuation-in-part of U.S. Ser. No. 08/437,853 filed May 9, 1995, now abandoned, which is a continuation-in-part of U.S. Ser. No. 08/386,743 filed Feb. 10, 1995, now abandoned.

FIELD OF THE INVENTION

The invention relates generally to doors comprising a pliable door curtain, and more particularly to an improved curtain guiding assembly for a soft edge door with a selectively tensioned leading edge.

BACKGROUND OF THE INVENTION

Industrial doors in which the door itself is made of pliable material such as fabric, are used in a variety of applications, typically for the purpose of separating areas within a building, or closing off building entries from the outside. Examples of such pliable doors are planar doors, overhead-storing doors and roll-up doors. Planar doors include frame members on which the fabric comprising the door is disposed. This plane of material is then movable between a doorway blocking position and a storage position, wherein the plane of material and associated frame members are disposed above the doorway. The frame typically includes extensions extending past either side of the door, and which are receivable within guide tracks to guide the door through its vertical movement. These extensions may include wheels or trolleys. An overhead-storing door is similar in that the fabric door is maintained on frame members and is movable between doorway blocking and storage positions. In this door, however, the storage position is overhead, as in a typical garage door. Accordingly, the guide members associated with such a door will curve between the vertical and horizontal. A typical roll-up door comprises a fabric curtain which is wound about a roller journalled for rotation above the doorway with which the roll-up door is associated. To close the door, the roller is rotated such that the curtain pays off of the roller to enclose the doorway. Of course, the door is opened by reversing the direction of the roller and rolling the fabric curtain onto the roller. Such roller doors are typically either powered opened and closed, or are powered open and allowed to fall closed by gravity. As the invention herein is envisioned for use primarily with roll-up doors, it will be described with reference thereto. However, the invention may also be used in combination with other such pliable doors. Further, the invention may also be applied to industrial doors that are mounted for horizontal as opposed to vertical operation.

When a roll-up door is placed over an exterior doorway of a building, provision must be made to prevent the fabric curtain from billowing due to wind being applied from the outside. Similarly, when the roll-up door is in place between different sections of a warehouse, there may be pressure differentials between these two sections, which may also cause billowing of the roll-up door if the door does not have provision to prevent this from happening. Such billowing may be problematic as it impedes door function and allows leakage around the door. To correct for this problem, roll-up doors typically include a rigid or semi-rigid bottom bar to help in providing what is generally referred to as "wind retention". The bottom bar typically extends across the leading width of the door, and also includes extensions which extend past either side of the door. These extensions typically engage side frames disposed on either side of the door and which run vertically along the side of the doorway. As the door moves between its open and closed positions, the bottom bar and its extensions move within a generally vertical plane since the extensions engage and are guided along or within the generally vertical side frames. With the leading edge of the door thus restrained within a vertical plane, movement of the fabric curtain of the door out of that vertical plane is largely avoided. However, the bottom bar only ensures that the leading edge of the door stays in the vertical plane, and strong gusts of wind or large pressure differentials between sections of a building may still allow the remainder of the curtain to billow either during the curtain's travel, or when it is fully closed.

To prevent this undesirable movement of the door, many prior art doors provide wind retention by use of a tensioning means to place a vertically disposed tension on the door to prevent it from billowing out of the vertical plane. One example of such a tensioning means is a heavy bottom bar. The weight of the heavy bottom bar may provide sufficient vertical tension to prevent undesirable billowing particularly (although not exclusively) in a gravity-fall type door. Alternatively, external means may be used to provide the necessary tension. For example, belting is often used for this purpose. Typically, one end of the belting is attached to the roller, and is wound and unwound from the roller in the opposite sense from the curtain. The belt is then passed through a pulley mounted near the bottom of the side frame. The other end of the belt is then attached to the extensions of the bottom bar. As the belt is wound and unwound from the roller in an opposite sense to the curtain, it exerts a downward pulling force on the bottom bar and the side frame inserts thus placing the necessary vertical tension on the door. Other particular arrangements for the belting besides that previously described are also used to achieve the same purpose. Further, it will be appreciated that while reference has been made to a "bottom bar," this description may also refer to a bar disposed on the leading edge of a horizontally disposed door.

A further exemplary means for exerting the necessary vertical tension on the door, at least in the closed position, is a system wherein the extensions of the bottom bar are latched in position when the door is in the closed position. In the case of the powered roll-up door, the motor is then reversed to exert the necessary vertical tension of the door to hold it taut.

While the variety of methods just described for wind retention are generally effective in preventing this problem, they are not without their own disadvantages. For example, obstacles in the path of travel of the bottom bar may be problematic. If an obstacle is in place in this position, and the door continues its downward movement, damage to either the door or the object could occur. Further, if the obstacle should be personnel, goods or equipment either damage to the door, goods or equipment or injury to the personnel could result. To avoid this problem, doors employing bottom bars typically also include some type of sensing mechanism for determining when an obstacle has been encountered. These sensors are coupled to the motor which drives the roller, and cause the door to be reversed upon encountering an obstacle. Such sensors, however, may be subject to malfunction, and add both cost and complexity to the door.

SUMMARY OF THE INVENTION

The present invention overcomes these deficiencies by providing an assembly for use with an industrial door for selectively blocking and unblocking a doorway having guide members disposed on opposite sides thereof. The assembly includes a resilient member disposed adjacent the leading edge of a door curtain. The resilient member is substantially untensioned when no external force is applied to the door curtain and is adapted to at least partially conform to or at least partially deflect about encountered obstacles. The assembly also includes guide extensions coupled to either end of the resilient member. Each of the guide extensions engages a respective one of the guide members to guide the movement of the door curtain. The resilient member becomes tensioned upon application of an external force having a component directed opposite a direction of movement of the door curtain, and/or which causes deformation of the resilient member in that direction, and a magnitude greater than a first predetermined threshold.

In the preferred embodiments, the resilient member returns to its substantially untensioned state upon removal of the external force, and the resilient member is deformable in the direction of the component of the applied force. In some preferred embodiments, the resilient member and the guide extensions are preferably coupled to at least partially release when the door curtain is subjected to an external force having at least a component directed opposite the direction of movement of the door curtain and a magnitude greater than a second predetermined threshold. In some of the foregoing embodiments, the resilient member returns to its substantially untensioned state upon removal of the external force or after the resilient member and the guide extension have released in response to application of an external force greater than the second predetermined threshold. In some embodiments, the releasable coupling between the resilient member and the guide extensions is affected by an edge member attached between those two components.

In some preferred embodiments, the assembly is further provided with a first pair of retention extensions. Each of the retention extensions in the first pair engage a respective one of the guide members and an edge of the curtain. At least one of the first pair of retention extensions is adapted to at least partially release from its respective edge of the curtain when the door curtain is subjected to an external force having a magnitude greater than a third predetermined threshold. In some embodiments, the guide extensions are located between the first pair of retention extensions and the leading edge of the door curtain. The first pair of retention extensions tension the door curtain therebetween to reduce the amount of wind load experienced by the guide extensions.

In other embodiments, the assembly is further provided with a second pair of retention members located a distance away from the first pair of retention members. In such embodiments, the first and second pairs of retention members and the guide extensions are located to distribute wind loads in a predetermined manner. It is preferable in these embodiments to adapt at least one of the first and second pairs of retention members to at least partially release from the curtain, and the guide extensions to at least partially release from the resilient member at substantially the same time when subjected to an external force of sufficient magnitude.

In any of the foregoing embodiments, the resilient member may comprise a discrete member such as a strap of webbed belting or a braided steel cable, or it may alternatively be the door curtain itself.

In accordance with another important aspect of the invention, deficiencies of the prior art are overcome by providing an assembly for use with an industrial door for selectively blocking and unblocking a doorway having guide members disposed on opposite sides thereof. The assembly includes a first pair of guide extensions located on opposite sides of a door curtain adjacent a leading edge thereof. Each of the guide extensions in the first pair engages a respective one of the guide members to guide the movement of the door curtain. The first pair of guide extensions are restricted from moving toward the center of the door curtain without pre-tensioning a first resilient member disposed adjacent the leading edge of the door curtain. (The first resilient member can comprise the door curtain itself.) The assembly also includes a second resilient member or curtain section extending across the door curtain and spaced a distance from the first resilient member. In addition, the assembly is provided with a second pair of guide extensions coupled to either end of the second resilient member and engaging a respective one of the guide members to guide the movement of the door curtain. The second pair of guide extensions is restricted from moving toward the center of the door curtain. However, unlike the first pair of extensions noted above, the second pair of guide extensions tension the second resilient member therebetween. The leading edge of the door curtain and the first and second resilient members can at least partially conform to or at least partially deflect about encountered obstacles.

Preferably, the first and second resilient members are deformable in any direction. In certain embodiments, the assembly is also provided with edge members in cooperative engagement with respective ones of the guide extensions in the second pair. Each of the edge members are coupled to a respective one of the ends of the second resilient member. At least one of the edge members is coupled to at least partially release from its respective guide extension when the door curtain is subjected to an external force having a magnitude greater than a first predetermined threshold.

In any of the foregoing embodiments, the resilient member may comprise a strap of webbed belting material, a braided steel cable, or, alternatively, it may comprise the leading edge of the door curtain.

In accordance with still another aspect of the invention, a curtain guiding assembly for guiding an industrial door for selectively opening and closing a doorway defined by oppositely disposed guide members is provided. The curtain guiding assembly includes a resilient member extending across the door curtain. It also includes a first trolley located at a first edge of the door curtain. One end of the resilient member is secured to the first trolley. The assembly is further provided with a second trolley disposed at a second edge opposite the first edge of the door curtain. The second trolley has first and second wheels. A pivotable member is associated with the first wheel of the second trolley. The assembly includes means for releasably coupling the resilient member to the pivotable member and means for pivoting the pivotable member to tension the resilient member between the first and second trolleys.

Preferably, the resilient member acts as a wind retention bar. The resilient member is also preferably adapted to at least partially conform to or at least partially deflect about encountered obstacles. In some embodiments, the resilient member comprises the door curtain. In some embodiments, the pivoting means comprises a lever in cooperative engagement with an eccentric.

DETAILED DESCRIPTION OF THE PREFERRED EMBODIMENTS

While the invention will be described in connection with certain preferred embodiments, there is no intent to limit it to those embodiments. On the contrary, the intent is to cover all alternatives, modifications and equivalents included within the spirit and scope of the invention as defined by the appended claims.

Figure 1:
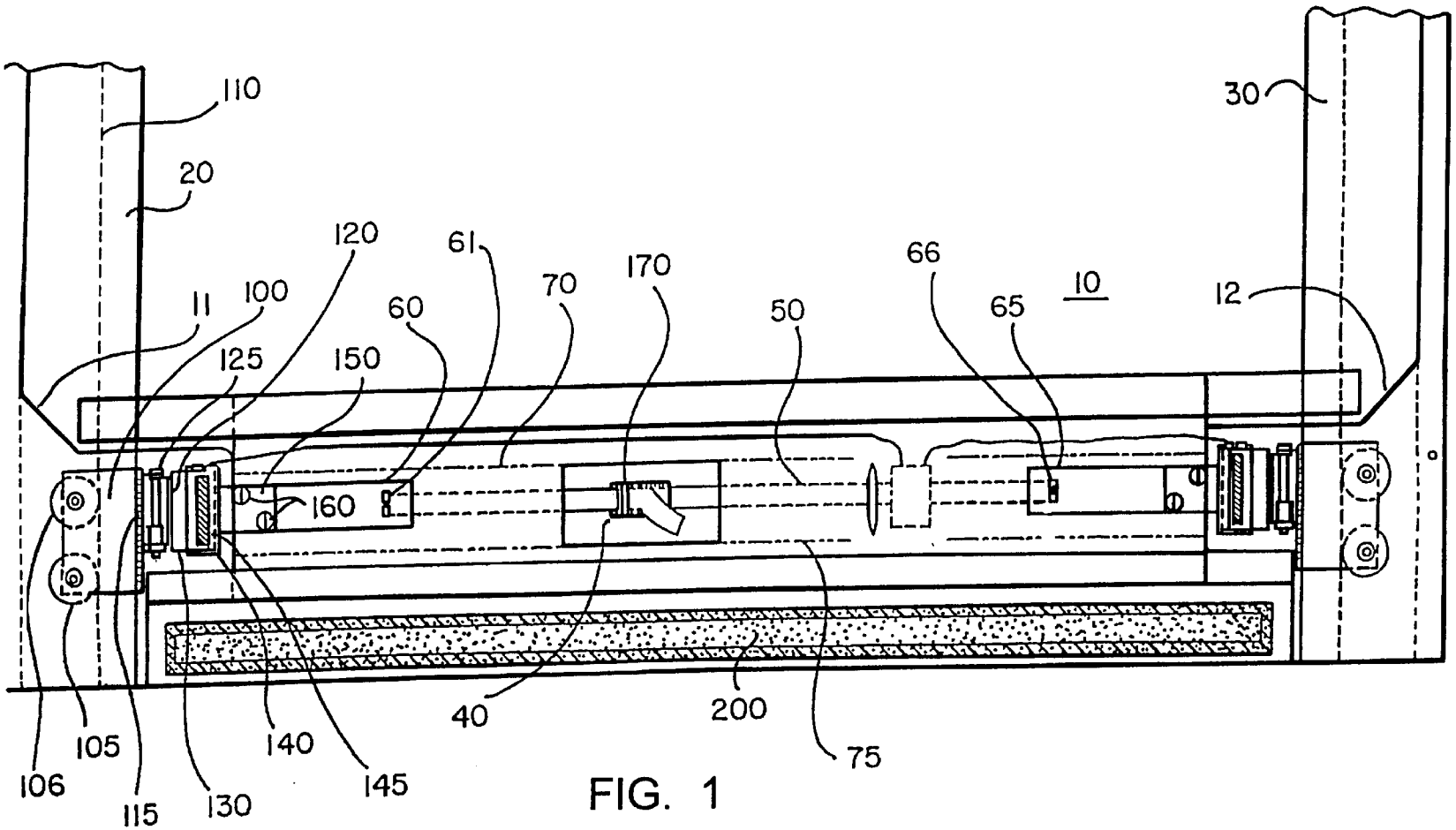
FIG. 1 is an elevational view of a curtain bottom tensioning assembly shown in connection with a breakaway side frame insert mechanism.

Turning now to FIG. 1, there is shown a curtain edge tensioning assembly, particularly—a tensioning assembly on the bottom or leading edge of a vertically operating roll-up door. As mentioned, however, the tensioning assembly may be used in combination with other industrial doors including planar doors and overhead storing doors, or with horizontally operating doors. In the illustrated assembly, the curtain bottom tensioning assembly includes a resilient member and other components mounted to a leading edge of the curtain door, and restrained side frame inserts which are coupled to the side frames to place the resilient member across the bottom of the door in tension. The sideframe inserts are "restrained" in that they are prevented from moving toward the center of the door, as detailed below. In this embodiment of a vertically operating door, restraint of movement toward the center of the door is a horizontal restraint. The components across the bottom of the door will be referred to herein as a "soft bottom bar." The use of this term is not intended to be limiting, however. Rather, the term is meant to refer to instances where discrete components are disposed along the curtain edge, as in this embodiment, and instances where the fabric of the door curtain itself forms the resilient member, as will be described in greater detail below.

The curtain bottom tensioning assembly shown in FIG. 1 is designed to be used with a conventional roll-up door including a fabric curtain 10, the leading edge of which is illustrated in FIG. 1. Vertical guide members, illustratively in the form of side frame members 20, 30, which support the roller upon which the curtain is wound, are disposed laterally along either side of the door, and include vertical side channels which may receive the sides of the curtain above the bottom bar section, as well as guide extensions which are attached to the bottom bar, and are discussed in greater detail below. The curtain 10, in the area of the soft bottom bar, is optionally of reduced width, with the curtain narrowing for example in the sections 11, 12 shown in FIG. 1. The soft bottom bar, designated generally by the reference numeral 40 in FIG. 1 is shown disposed in this preferably narrower section of the curtain 10 at or near its bottom edge.

In the assembly shown in FIG. 1, the soft bottom bar 40 is comprised primarily of a resilient member in the form of a strap 50 which extends across the bottom edge of the door. Other types of resilient members besides strap 50 could be used, such as resilient cable, rope and the like, with ⅛ braided steel rope being particularly preferred. To anchor the strap or other resilient member at either end of the door, and to provide added stiffness in that area, semi-rigid end stiffeners 60, 65 receive respective ends of the resilient strap 50. End stiffeners 60, 65 are generally rectangular in shape, with their major axis extending along the horizontal width of the door. Each stiffener 60, 65 includes a slot 61, 66 which is sized to receive the width of the resilient strap 50. In the assembly of FIG. 1, the strap 50 is received within the slots 61, 66, near its respective ends. Each end of the strap is then sewn onto a portion of the strap 50 near the end stiffeners 60, 65 thus forming a loop of the strap 50 received within the slots 61, 66. In the illustrated assembly, strap 50 is actually two straps, one attached to stiffener 60, and one to stiffener 65. The two straps are coupled through a centrally-disposed tightening member 170, to be discussed in greater detail below. A variety of resilient materials may be used for the resilient strap 50. As will be discussed below, in some assemblies the strap 50 will have a tension applied to it so as to stretch it illustratively 2–5% longer than its unstretched length. A resilient material providing such stretch without requiring undue force is thus required. At present, the best material we have found for use as strap 50 is a webbed belting material in the form of a 1 inch wide polyester belt, with a 1,000 pound rating. The belt is manufactured by S.I.R. Webbing, Inc; Model Number 17337. As mentioned, the preferred resilient cable, if used, is ⅛" braided steel rope, available from a variety of sources.

As can be seen from FIG. 1, the resilient strap 50 and the end stiffeners 60, 65 are preferably received within a pocket formed on the fabric curtain 10. As an alternative, resilient strap 50 could be sewn directly to the curtain fabric. In FIG. 1, this pocket is in two sections 70, 75 shown in broken lines. The pocket serves primarily to maintain the strap 50 and end stiffeners 60, 65 in the proper vertical position on the curtain 10.

Guide extensions extend past either side of the door curtain and engage the guide members to guide the door in a plane of movement. It will be appreciated that the invention is not limited to use with doors moving within a plane. On the contrary, the invention is applicable to doors moving through multiple planes, or in a non-linear manner, such as along an arcuate path. In the illustrated assembly, the guide extensions are in the form of side frame insert assemblies which are received within the vertical guide members in the form of side frames. The end stiffeners 60, 65 are preferably coupled to these side frame inserts which preferably also include a release or breakaway feature. In the assembly illustrated in FIG. 1, end stiffeners 60, 65 are coupled to magnetic breakaway side frame insert assemblies, as disclosed and claimed in U.S. patent application Ser. No. 08/386,436 (now U.S. Pat. No. 5,638,883) which was filed concurrently with the great-grandparent application of this application and which is hereby incorporated in its entirety by reference. While, in this illustrated assembly, a breakaway or indirect coupling between guide extensions and the resilient member is disclosed, the invention may encompass a non-breakaway or direct coupling as well. As used herein, "breakaway" refers to a complete separation between two components and to a release between two components wherein the relative positions of the components change without completely separating or detaching the components.

Figure 2:
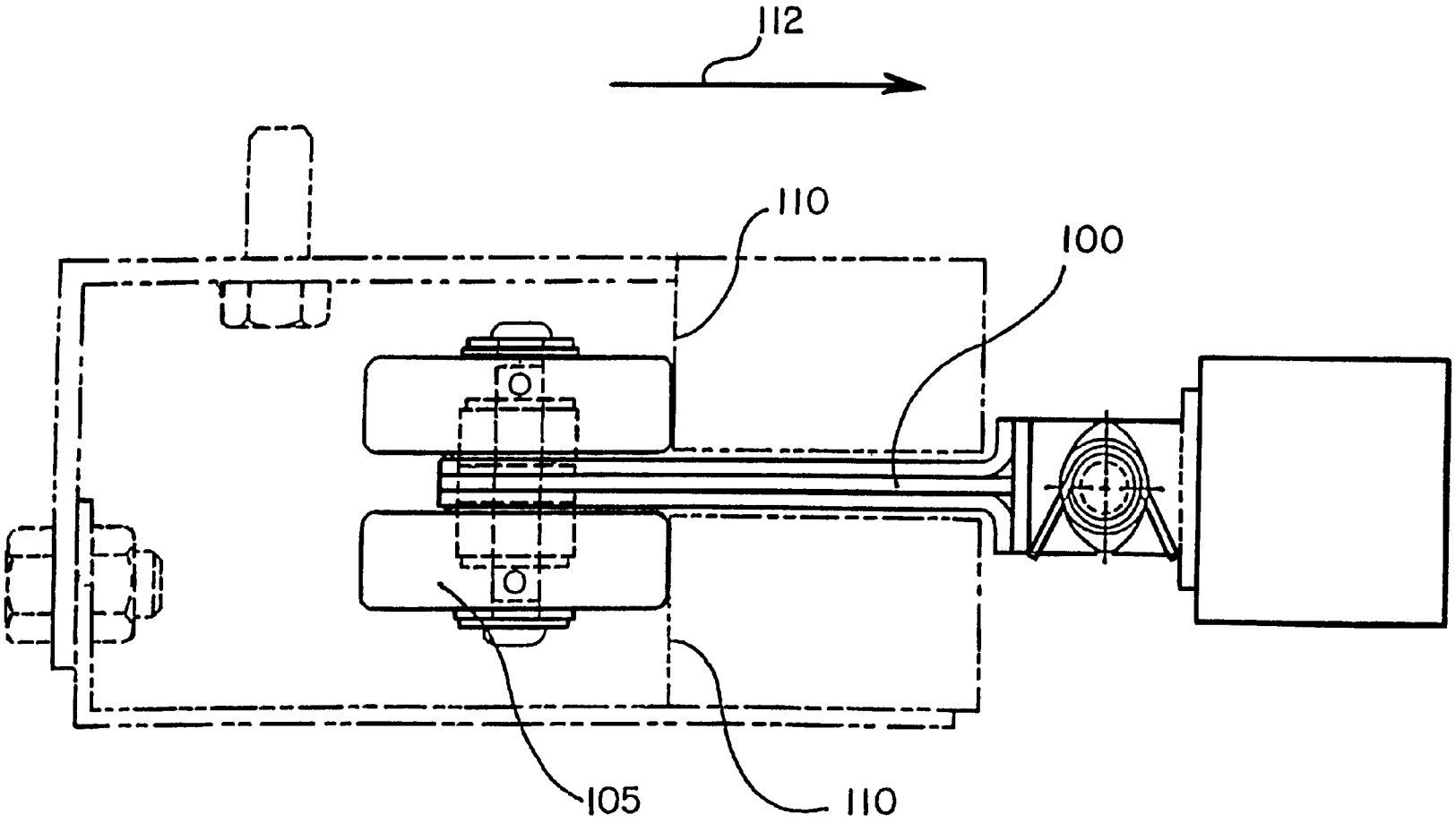
FIG. 2 is a top view of a horizontally restrained guide extension.

A magnetic breakaway side frame insert as disclosed in the '436 application will now be described in sufficient detail so as to enable one of skill in the art to understand it. Since the side frame inserts on either side of the door are the same, only one will be described. A side frame insert in the form of a trolley 100 is received within the side frame 20. The trolley is comprised primarily of a flat piece of metal or other rigid material, having trolley wheels 105, 106 secured to the front and back of the trolley, for free rotation therewith. The side frame 20 includes a horizontally extending projection, one of which is shown in a broken line at 110 in FIG. 1. The trolley wheels engage this projection 110, to guide the trolley in vertical movement within the side frame as the fabric curtain 10 is raised and lowered. This arrangement of trolley wheels and horizontal projection 110 can be seen more clearly in FIG. 2.

Returning to FIG. 1, coupled to the plate of the trolley 100 is a first c-shaped bracket 115. A second c-shaped bracket 120 is received within the first c-shaped bracket 115, and they are hinged together by a hinge pin 125. Attached to the second c-shaped member 120 is a coupling magnet 130. The coupling magnet 130 is received within a cup assembly 140 comprised of plastic or other non-ferrous material. The cup assembly 140 receives a ferrous member 145 in its interior, which extends out the back of the cup and toward the bottom bar of the door curtain to which the magnetic breakaway mechanism is attached. In FIG. 1, the portion of the ferrous member extending out of the back of the cup is shown, and designated by reference number 150. This portion of the magnetic breakaway mechanism 150 is attached to the bottom bar of the roll-up door. With coupling magnet 130 received within magnetic cup assembly 140, and magnet 130 magnetically coupled to the ferrous member 145, the breakaway mechanism is assembled for operation. The side frame inserts just described break away when sufficient force is placed on the door, which overcomes the magnetic force coupling magnet 130 and ferrous member 150. As is described in significantly greater detail in the filed '436 application, this breakaway mechanism has the significant advantage of being omni-directional, and breaking away for a variety of directions and magnitudes of forces that are exerted on the door. Advantageously, this breakaway mechanism enjoys the ability to breakaway or release when the curtain is subjected to a force having a component directed opposite the direction of movement of the door curtain (i.e., up for a vertically traveling door) and a magnitude greater than a predetermined threshold. By way of example, not limitation, that threshold could be approximately 60 lbs. for a door covering an approximately 8 foot wide, rectangular door opening and having a leading edge adapted to deflect approximately 12 inches before break away or release occurs; and where the force required to release the releasable connection is approximately 250 lbs.

While the breakaway mechanism has been described in some detail, it is only a representative example of the type of breakaway mechanism usable with the curtain bottom tensioning assembly. In the exemplary guide extension in the form of a breakaway side frame insert, just described, the engagement of the trolley wheels 105, 106 with the horizontal projection 110 in side frame 20 restrict the trolley from horizontal movement in the direction of the arrow 112 of FIG. 2. One skilled in the art will appreciate that other restricted guide extensions may be advantageously employed. Such restricted guide extensions require contact between the extension and the guide member to restrict the movement of the extension while also providing for smooth movement of the extension along the guide member during travel of the door. In the illustrated assembly the side frame insert includes an engagement member, which engages the side frame to perform both of these functions. The engagement member in the present embodiment is in the form of the plurality of trolley wheels 105,106. Alternative designs of the insert could also achieve the functions of the engagement member. It should also be noted that, if desired, the guide extension need not include a breakaway function as in the side frame inserts of the filed '436 application. Further, while the presently-described breakaway mechanism provides for separation of the bottom bar and side frame insert outside of the side frame, other approaches are also acceptable. For example, given the resilient nature of the bottom bar or tensioning assembly, the resilient member itself could extend into the side frame, with breakaway between the resilient member and a side frame insert occurring inside the side frame.

As mentioned, a guide extension having restriction of movement toward the curtain center allows a tension to be applied to the strap 50 upon attachment of the soft bottom bar to the respective guide extensions or inserts. This attachment is achieved by means of end stiffener 60 being coupled to the magnetic breakaway side frame insert by means of bolts 160 which couple, for example, the ferrous member 150 to the end stiffener 60. With end stiffener 60 coupled to the side frame insert, the stiffener 60 and resilient strap 50 (along with the other end stiffener/insert member combination) along with cup assembly 140 comprise the bottom bar across the bottom of curtain 10 which attaches the curtain to the side frame inserts, and also serves to stiffen the bottom edge of the curtain to provide wind retention. Strap 50 has an unstretched length before attachment of the cup assembly 140 to horizontally restricted side frame inserts. The strap 50 is then stretched to a length illustratively 2–5% longer than its unstretched length. This loading or stretching of resilient strap 50 upon securement to the horizontally restricted inserts ensures that the strap is taut enough across the bottom of the door to perform the desirable bottom bar functions including wind retention.

At the same time, however, the soft edge or bottom bar can substantially conform to or deflect around obstacles. That is, upon the soft bottom bar encountering an obstacle, the presence of either the resilient strap 50 or another resilient member instead of a conventional rigid member allows the soft bottom bar to substantially conform to or deflect around whatever obstacle is encountered. By use of the term "substantially conform to or deflect around" it is intended to convey that the engagement between a soft bottom bar and an obstacle can result in the bottom bar taking on several possible configurations. This function is provided for by the fact that the bottom bar is in the form of a resilient member as opposed to a conventional rigid member. The soft bottom bar may "substantially conform" to an obstacle by the profile of the bottom bar taking on the profile of the obstacle. Of course, depending on the height of the obstacle above the floor, such "conforming" of the bottom bar may only take place over a portion of the obstacle. However, if the object is short enough, the bottom bar may be entirely conformed about the outer upper surfaces of the obstruction. In such a situation, the soft bottom bar is designed to allow, for example, the obstruction to be pulled out from underneath the door, with the bottom bar conformed around it in this configuration. This ability to remove the obstruction without a need for stopping and reversing the direction of the door is advantageous. Further, the resiliency of the bottom bar prevents the obstacle from being crushed by continued downward travel of the door to the floor, as might be the case with a conventional, rigid, bottom bar.

In other situations, the soft bottom bar may "deflect" about the obstruction. For example, if the obstruction only partially projects into the plane of the door, the descending bottom bar may engage a surface of the obstacle, and then, by virtue of the resilient nature of the bottom bar, deflect about the obstacle such that the bottom bar and door may continue downward, albeit in a slightly different plane then that in which the door was traveling prior to encountering the obstruction. Whether the door conforms to or deflects about the article will depend on which of these represents the path of least resistance to the continued travel of the door.

The provision of both "conforming" and "deflecting" of the soft bottom bar significantly enhances the safety of this bottom bar as compared to rigid, non-deflecting and non-deforming bottom bars. Further, the need for a sensing means for immediately stopping or reversing the door upon contact with an obstruction may be eliminated. When the soft bottom bar is advantageously used with the omni-directional breakaway side frame insert disclosed in U.S. patent application Ser. No. 08/386,436, breakaway of the soft bottom bar may occur as the bottom bar conforms to the obstructing object.

To provide adjustability to the tension in the soft bottom bar, an adjustable tightening member 170 is included in the assembly illustrated in FIG. 1. Such adjustability may be desirable, for example, when increased wind retention is necessitated by changing environmental or atmospheric conditions. As illustrated, tightening member 170 is in the form of a buckle which receives ends of two sections of the resilient strap 50, and is adjustable and securable along the lengths thereof. Alternatively, the resilient strap 50 may be a single strap extending through both slots 61, 66 with the two ends attached to or engaged with tightening member 170. The presence of an adjustable tightening member allows the tension of the resilient belt 50 or other resilient member to be adjusted as may be desirable for a given environment. With the respective ends of the adjustable soft bottom bar coupled to horizontally restrained side frame inserts, the tension on the resilient strap 50 can be increased without the risk of pulling the side frame inserts inwardly so that they no longer engage the side frame. Further, if the adjustable soft bottom bar is used with a magnetic breakaway side frame insert as described in U.S. patent application Ser. No. 08/386,436, the magnetic coupling may be advantageously adjusted in order to allow the desired tension to be placed on the resilient strap 50. With stronger magnetic coupling between the coupling magnet 130 and ferrous member 150, increased tension may be placed on the resilient strap 50. As previously noted, under typical circumstances it is assumed that resilient strap 50, or whatever resilient member is used, will only be stretched in the range of 2–5 percent of its length when it is coupled to whatever side frame insert is used in combination with the soft bottom bar. The presence of the tightening member 170 allows adjustment of this stretch amount as may be desired.

Figure 3:
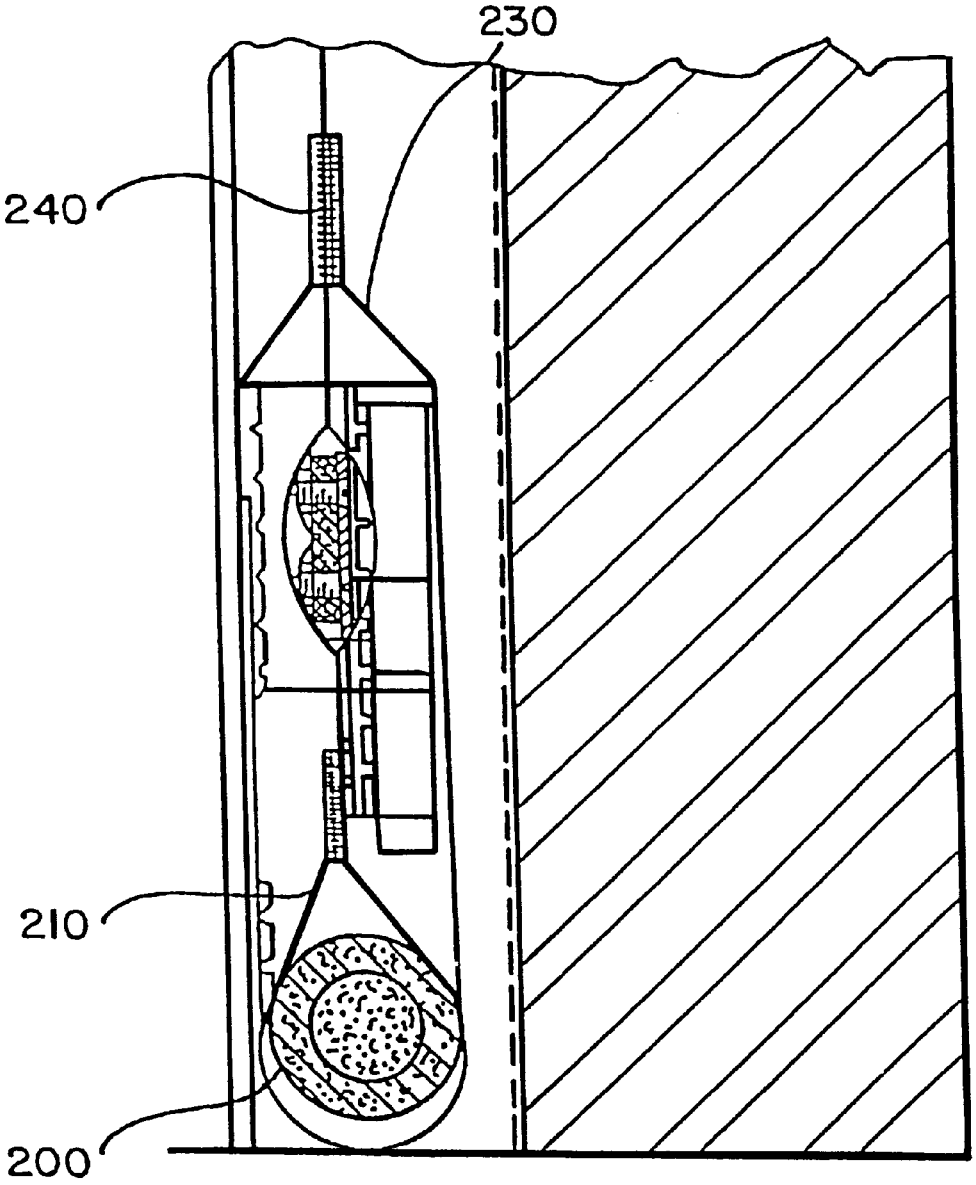
FIG. 3 is an end view of the leading edge of a roll-up door including a curtain bottom tensioning assembly and ballast tube.

The soft bottom bar also advantageously includes a ballast tube 200. The ballast tube 200 is preferably in the form of a resilient hose-type material filled with a compressible material such as sand, ground garnet, gel, silica, etc. which will allow the ballast tube to substantially conform to or deflect when the ballast tube contacts either the floor beneath the door opening, or an obstacle. With the hose material filled with sand, or one of the other listed compressible materials, the ballast tube 200 takes on a generally circular cross section, seen most clearly in the end view of FIG. 3. Ballast tube 200 is received within a loop 210 formed by the bottom of the curtain being doubled back upon itself although the ballast tube could be located at other positions of the door, including above resilient strap 50. The leading edge of the curtain and a portion of the curtain above the ballast tube 200 may advantageously be provided with complemental strips of Velcro® type fasteners. Of course, other means for forming the loop 210 in the bottom of the curtain may also be used.

Ballast tube 200 is advantageous in that it provides weight on the bottom of the door. This is particularly advantageous if the soft bottom bar is used in a gravity-fall door. In that situation, the weight of the ballast tube keeps the curtain taut in the vertical direction. At the same time, the ballast tube 200 filled with granular material is soft and pliable. Thus, the ballast tube 200 would also substantially conform to or deflect around any encountered obstacles like the soft bottom bar 20 described above. Moreover, the deformable ballast tube 200, when engaging the floor beneath the door in the closed position, provides an excellent seal preventing the escape or entrance of air beneath the bottom of the door.

To protect the leading edge of the curtain, the soft bottom bar 40, and the ballast tube 200 from undue wear, a loop seal 230 is preferably provided. The loop seal is preferably a piece of fabric, which is the same fabric of which curtain 20 is comprised although other materials could be used. As is seen most clearly from the side view of FIG. 3, the two ends of the loop seal are secured to the curtain at 240. Preferably, each end of the loop seal 230 is provided with Velcro®, and a strip of Velcro® is provided on both sides of the door as at 240 in FIG. 1. Loop seal 230 surrounds and protects the various components held within it.

As mentioned above, the soft bottom bar and horizontally restricted side frame inserts just described are only a representative embodiment of the curtain bottom tensioning assembly. In alternative embodiments, discrete components forming a "soft bottom bar" along the leading edge of the door are not required. In the case of the "soft bottom bar" just described, the resilient member was the strap 50. According to an alternative embodiment, however, the resilient member may be the leading edge of the curtain itself. This would require the curtain to be formed of a material having sufficient tensile strength and resiliency to perform the advantageous function of substantially conforming to or deflecting about encountered obstacles while under tension. One example of a suitable curtain material which would meet this criteria is manufactured by Seaman, and has part number 3150 (MFRLTA) and another is made by the same manufacturer and bears part number 8138XR-40. In such an approach, this resilient curtain fabric is stretched and the curtain ends are secured to the horizontally restricted guide extensions to form a curtain bottom tensioning assembly. The tension applied to the leading edge of the curtain could be adjusted, for example, by changing the relative position of the point where the guide extensions are attached to the curtain.

Figure 4:
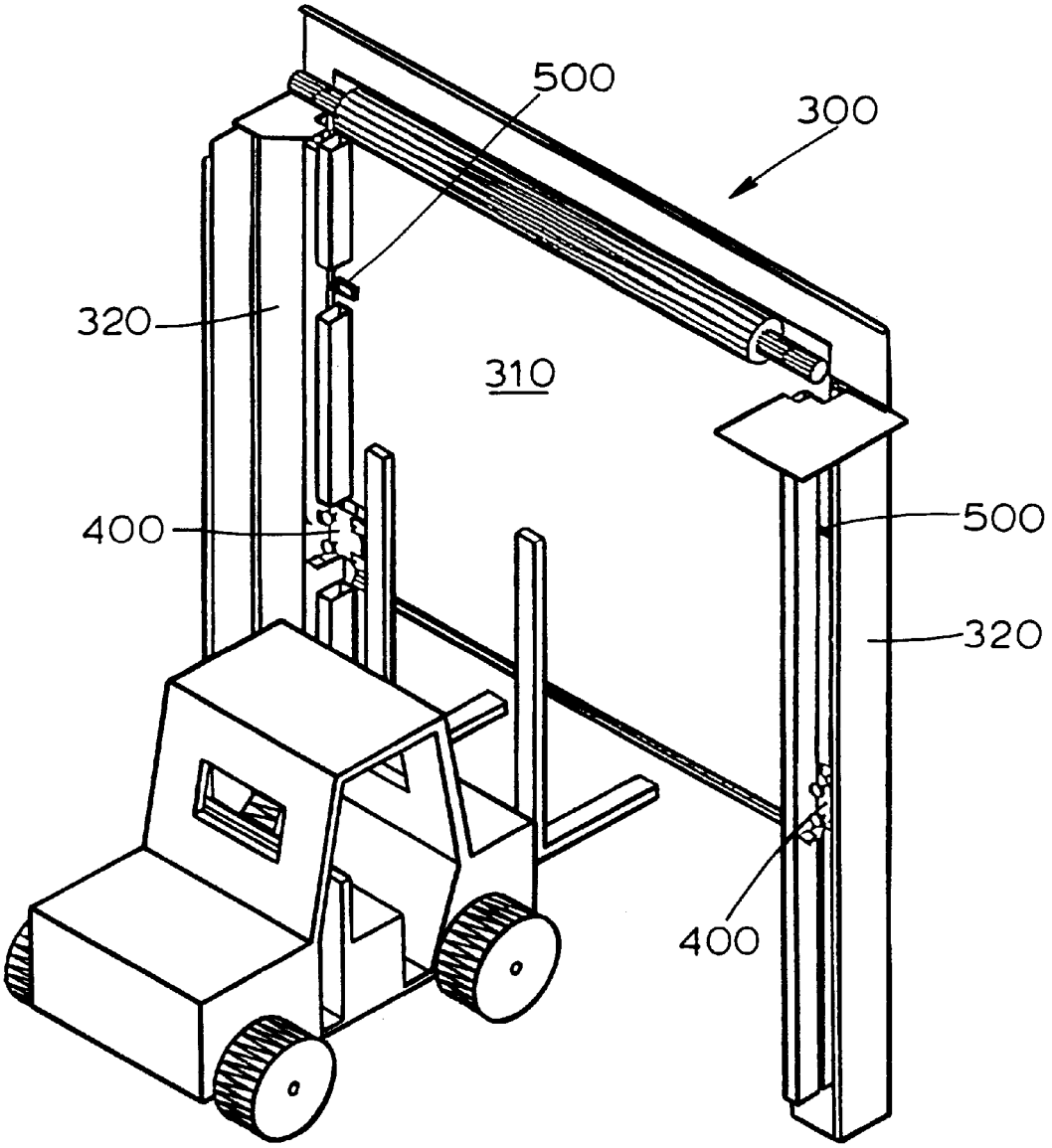
FIG. 4 is an isometric view of a door employing an edge tensioning assembly.

A presently preferred embodiment of a soft bottom bar using the curtain material itself, is shown in FIGS. 4–13. FIG. 4 shows the door 300 including a door curtain 310, the leading edge of which forms the soft edge or bottom bar. To stretch the leading edge of the curtain 310 to form the bottom bar, lateral edge portions of the leading edge of the curtain 310 are coupled to guide members that are restricted from movement toward the center of the curtain in the form of trolleys 400 which are received within and guided by guide members in the form of sideframes 320.

Figure 5:
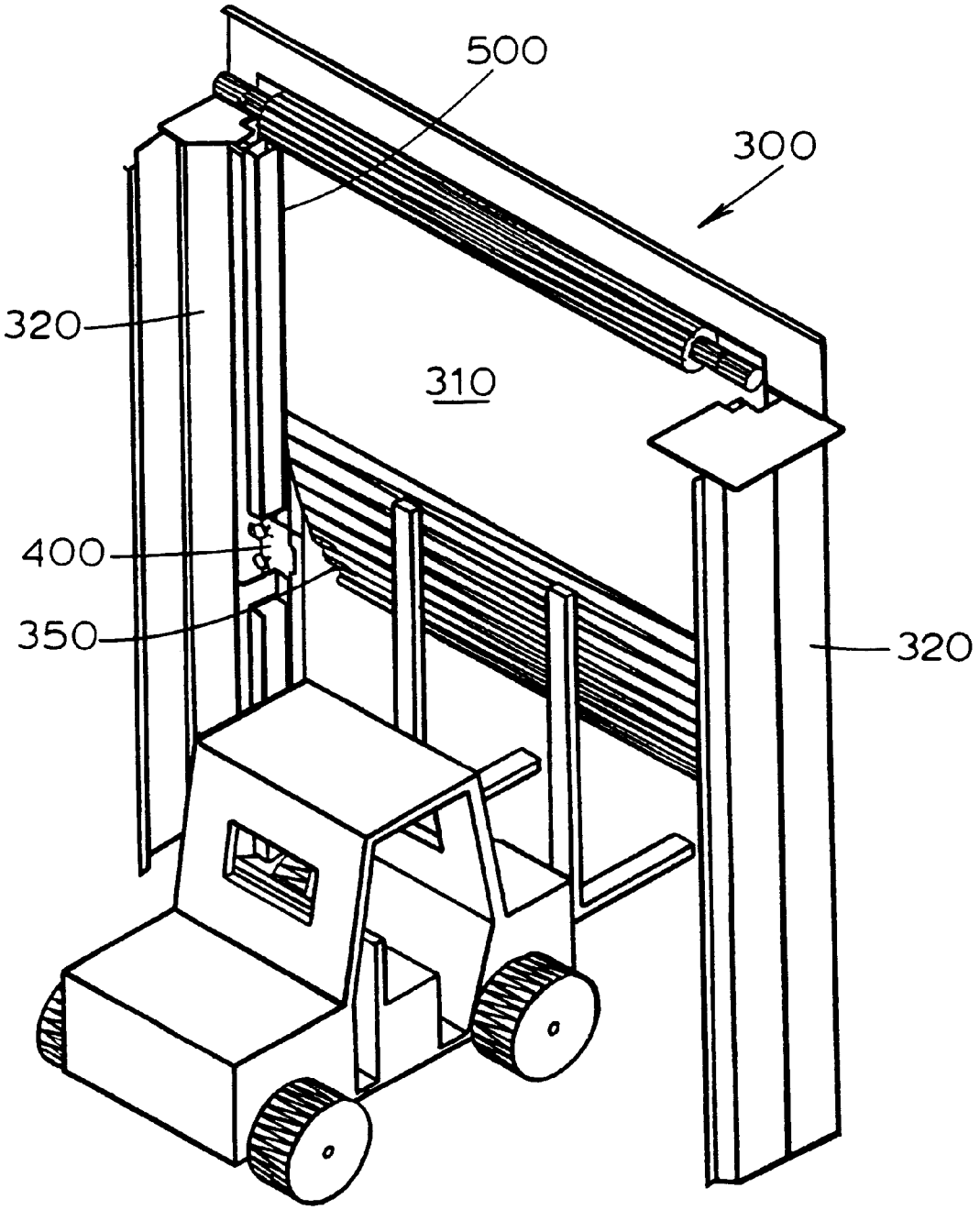
FIG. 5 is an isometric view of the door of FIG. 4, shown after impact by a fork truck.

In this embodiment, the sideframes extend vertically since the door is mounted for vertical operation. However, as explained above, the assembly could be used in a horizontal or other orientation, with the sideframes extending along the lateral edge of the curtain. With the lateral edges of the curtain coupled to the trolleys 400 (FIG. 4), the leading edge of the curtain forms a soft edge which can substantially conform to or deflect around obstacles, just as in the previous embodiments. For this purpose, the curtain 310 is preferably formed of single ply POLYESTER based woven fabric weighing 15 oz./sq. yard, and coated with a POLYURETHANE coating to a total weight of 65 oz./sq. Yard. The preferred source of this fabric is Seaman Corporation, Model No. 6660 OBU. The connection between the lateral edges of the curtain and the trolleys 400 is also releasable, as in the previous embodiments, for impacts or forces on the curtain above a predetermined magnitude. An example of the type of impact which would cause the separation of the curtain from the trolleys 400 is shown in FIG. 5—a forklift striking the door. Thus, the bottom bar has the advantage of being able to substantially conform to or deflect around encountered obstacles, and to breakaway for larger forces or impacts on the door.

Figure 6:
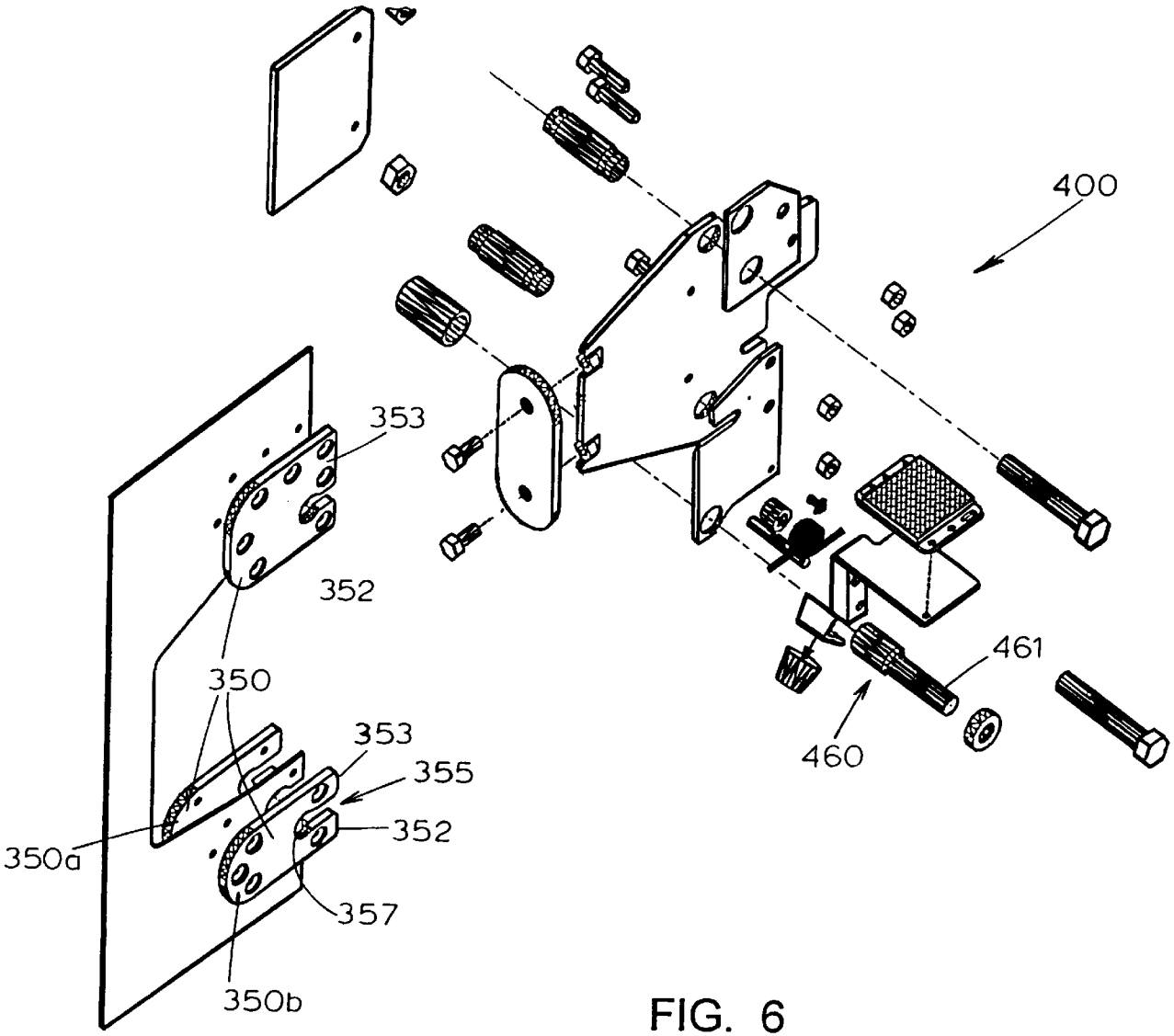
FIG. 6 is an exploded view of a trolley.
Figure 8:
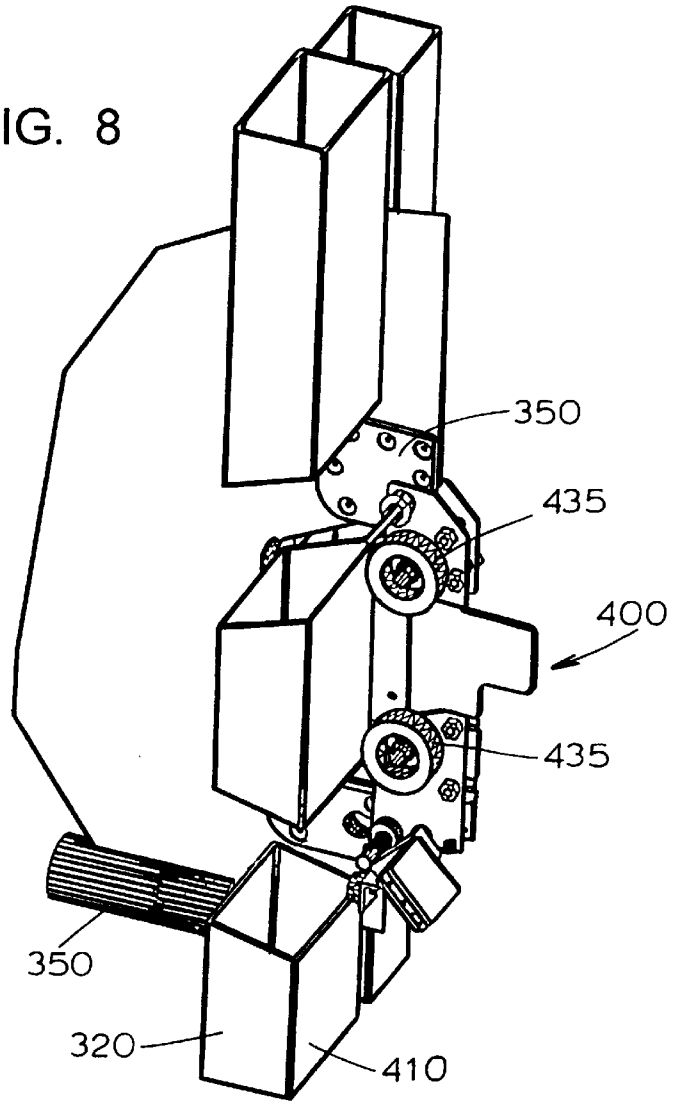
FIG. 8 is the structure shown in FIG. 7, but shown separated.
Figure 7:
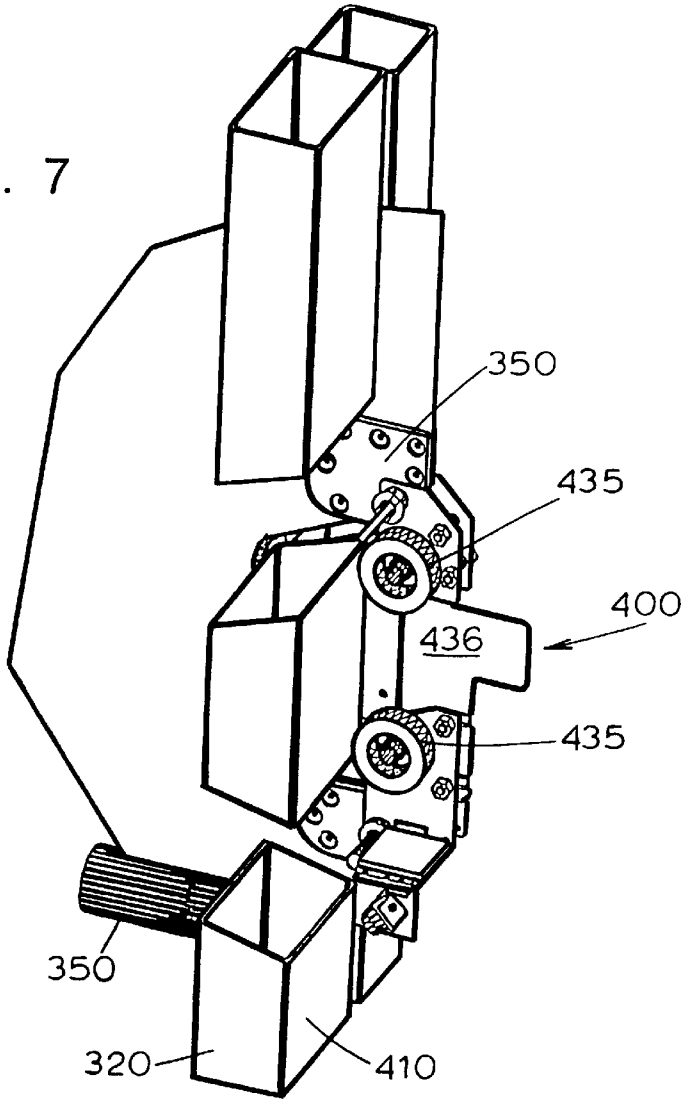
FIG. 7 is an isometric view of a trolley and strap.

The releasable coupling between the lateral edges of the curtain 310 and one of the trolleys 400 is seen in greater detail in the exploded view of FIG. 6, as well as in the two isometric views in FIGS. 7 and 8. It will be appreciated that the curtain will preferably include substantially the same structure at both lateral edges of the curtain. The portion of the releasable coupling associated with the curtain is in the form of at least one plate 350 fixed to the curtain's lateral edge near the leading edge thereof. As will be apparent from the figures, this embodiment includes two such plates 350 on each side of the door, which are similar in structure and function. Although either one plate or two could be used in this role, in the illustrated assembly two plates are used as one (the lower plate) serves an additional function of forming a part of a sensing system for sensing impact on the door, which system is the subject matter of U.S. patent application Ser. No. 08/686,996. Even though the lower plate serves this additional function, in combination with the leading edge of the curtain and the trolleys, it nonetheless also serves as a soft edge bar. For the purposes of this specification, the operation of the lower plate will now be described.

Plate 350 is illustratively formed of two halves 350*a* and 350*b*, including a portion of the curtain sandwiched therebetween. Rivets, screws, or other types of fasteners could be used to hold the two halves together. In the alternative, the plate 350 could be a unitary member fixed to the curtain. The coupling portion of the plate 350 is in the form of two arms 352, 353 which define a slot 355 therebetween. At the end of a slot is a detent 357, illustratively circular in shape.

For the purpose of coupling the plate 350 to the trolley 400, trolley 400 includes a post member 460 fixed thereto and disposed perpendicularly to slot 355 to engage in the slot 355 of the plate 350. The post member 460 shown in the exploded view of FIG. 6 includes a narrow portion 461 at one end thereof, which simplifies re-assembly of the releasable coupling following separation. The post 460 in the thicker region is designed to have a diameter approximately equal to the diameter of the detent 357 in the slot 355. This diameter is also slightly larger than the width of the slot 355. The post member 460 is preferably formed of NYLON 6/6, although NYLON 6/6 with a moly disulfide additive might likewise be appropriate in this role as may Nylon 6PB. With the post 460 disposed in the detent 357, the plate 350 and the trolley 400 are releasably coupled such that they can travel together as the door travels. Upon the occurrence of an impact or breakaway force on the door above a predetermined magnitude, however, the plate 350 will release from the trolley 400. For forces below the predetermined magnitude (such as might be applied to the door by wind or pressure differentials) separation of the first member and the second member is not desired and will, preferably, not occur.

For an impact into the plane of the doorway D (e.g. impact by a fork truck as in FIG. 5) the portion of the curtain between the plates 350 will bow inward. For an impact in the plane of the doorway (e.g. the traveling curtain encountering an obstacle), the curtain will bow in a direction opposite the direction of movement of the curtain. At the same time, the trolley 400 is restrained from moving in a direction toward the center of the curtain. To provide such restraint from movement toward the center of the curtain, trolley 400 illustratively includes rollers 435 disposed on either side of a body 436. These rollers, in turn, engage projections 410 on the sideframe 320, such projections being labeled in the isometric views of FIGS. 7 and 8. The engagement between the rollers 435 and the projection 410 prevents the trolley from moving toward the center of the curtain even when the leading edge of the curtain is deformed as described above by an impact on the curtain. Accordingly, the bowing of the curtain, combined with the restraint of the trolley 400 exerts a force on the plate 350 tending to separate the plate, and the curtain to which it is coupled, from the trolley 400.

In response to such a force the post 460 is pulled out of the detent 357 and into the main section of the slot. This action forces the arms 352, 353 to separate to allow continued passage of the post 460. The plate 350 is formed of a resilient material such that it will return to its original dimensions after the post 460 has been pulled completely out of the slot 355. Preferably, the plate 350 is formed of NYLON 6/6. However, NYLON 6/6 with a moly disulfide additive might likewise be appropriate.

The releasable coupling provides coupling of the trolley 400 and the plate 350 for unimpeded operation of the door, and also provides for separation of the plate 350 and trolley 400 for impacts on the door above a certain magnitude. The magnitude of impact that will cause such separation may be modified in a variety of ways. For example, by changing the composition of the curtain material, its resiliency may be increased or decreased, a decreased resiliency meaning that the curtain will deform less for the same impact, thus exerting a greater separating force on the releasable coupling, and causing separation of the plate and trolley for an impact on the door of a smaller magnitude. Alternatively, the structure of the arms 352, 353 on the plate 350 could be modified to give a greater resistance to separation from the trolley 400. An example of such a modification can be seen in the upper plate 350 of the exploded view of FIG. 6. As can be seen there, the upper arm 353 is thicker than the lower arm 352. The added thickness in the arm 353 requires a greater separating force to be exerted by the post 460 in order for the post to pull out of the slot 355. To lessen the force required for separation of the post and the slot, the post could be formed of a deformable material, such that it would compress as it was pulled out of the slot. Other examples of modifications that would change the magnitude of impact required to separate the plate and the trolley for this releasable coupling will be apparent to one of skill in the art. For example, the relative sizes of the slot 355 and/or the pin 460 could be adjusted to either increase or decrease the force required for the pin 460 to pass through the slot 355.

Figure 9:
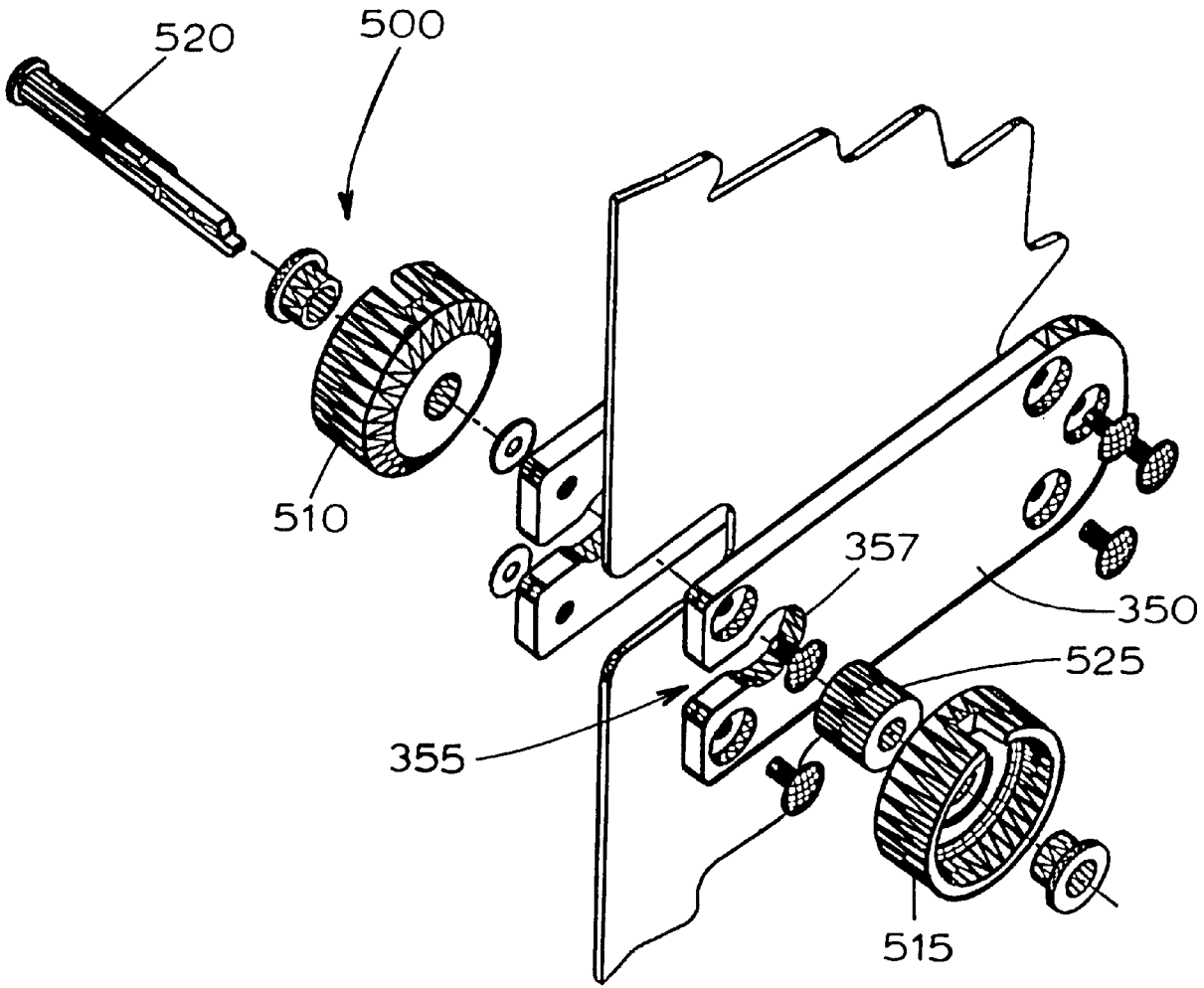
FIG. 9 is an exploded view of a wind clip for use with an industrial door.
Figure 11:
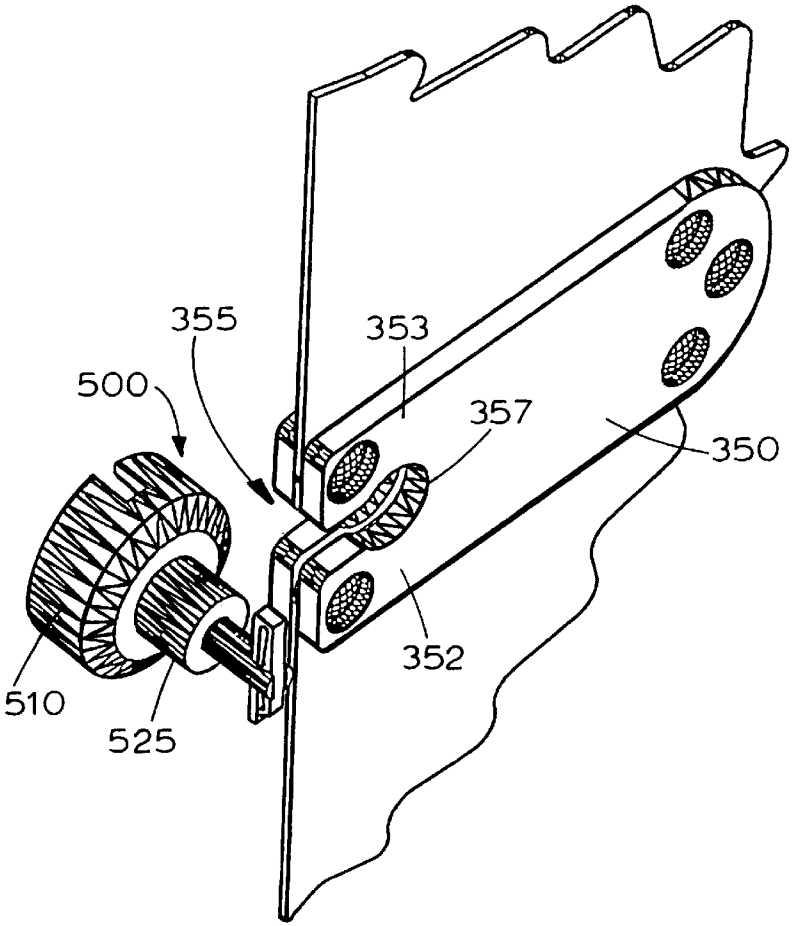
FIG. 11 is a view of the structure of FIG. 10, shown separated.
Figure 10:
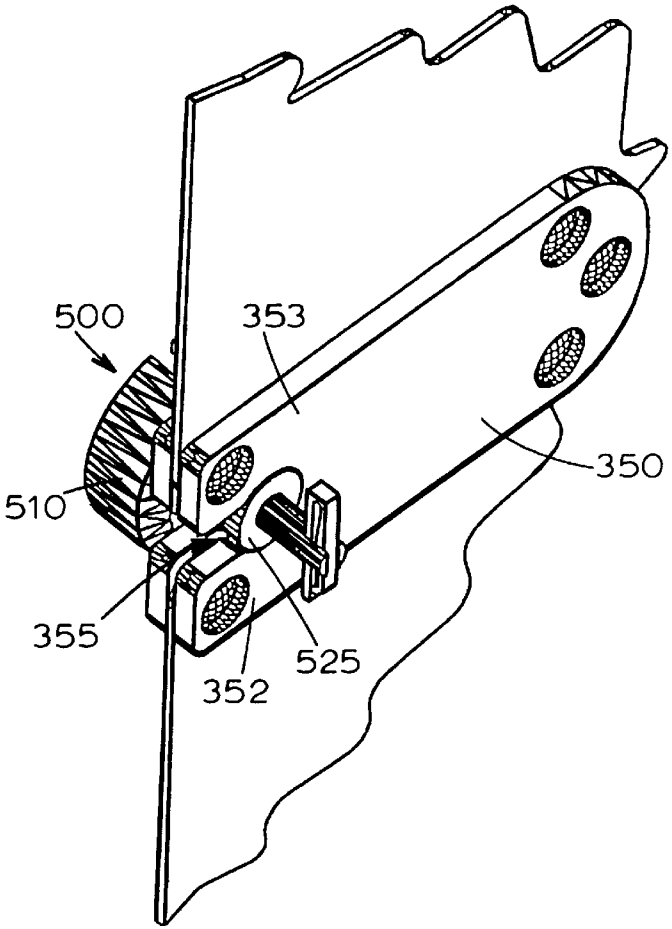
FIG. 10 is an isometric view of a wind roller and plate, shown in the attached position.

The releasable coupling may also be advantageously used for wind retention of lateral edges of the curtain at areas of the curtain other than its leading edge. An example of such a releasable coupling for wind retention higher on the curtain is seen in FIGS. 9–11, and in the overall view of the door in FIG. 4. In this case, the releasable coupling comprises the same plate 350 as was found at the leading edge of the door, and a modified trolley 500. The modified trolley is a set of trolley wheels 510, 515 joined by a removable axle 520. A roller or washer 525 fits over the axle. It is the combination of the axle 520 and the roller 525 that forms the post. As before, the post is designed with a diameter approximately equal to the diameter of the detent 357 at the terminal end of the slot 355, and slightly greater than the width of the slot 355. The axle 520 is preferably removable to allow easier re-assembly of the releasable coupling following release.

The trolley 500 is restrained from moving in a direction toward the center of the curtain. As best seen in FIG. 4, the trolley wheels 510, 515 engage the projection 410 on the sideframe, thus preventing such movement.

Figure 12:
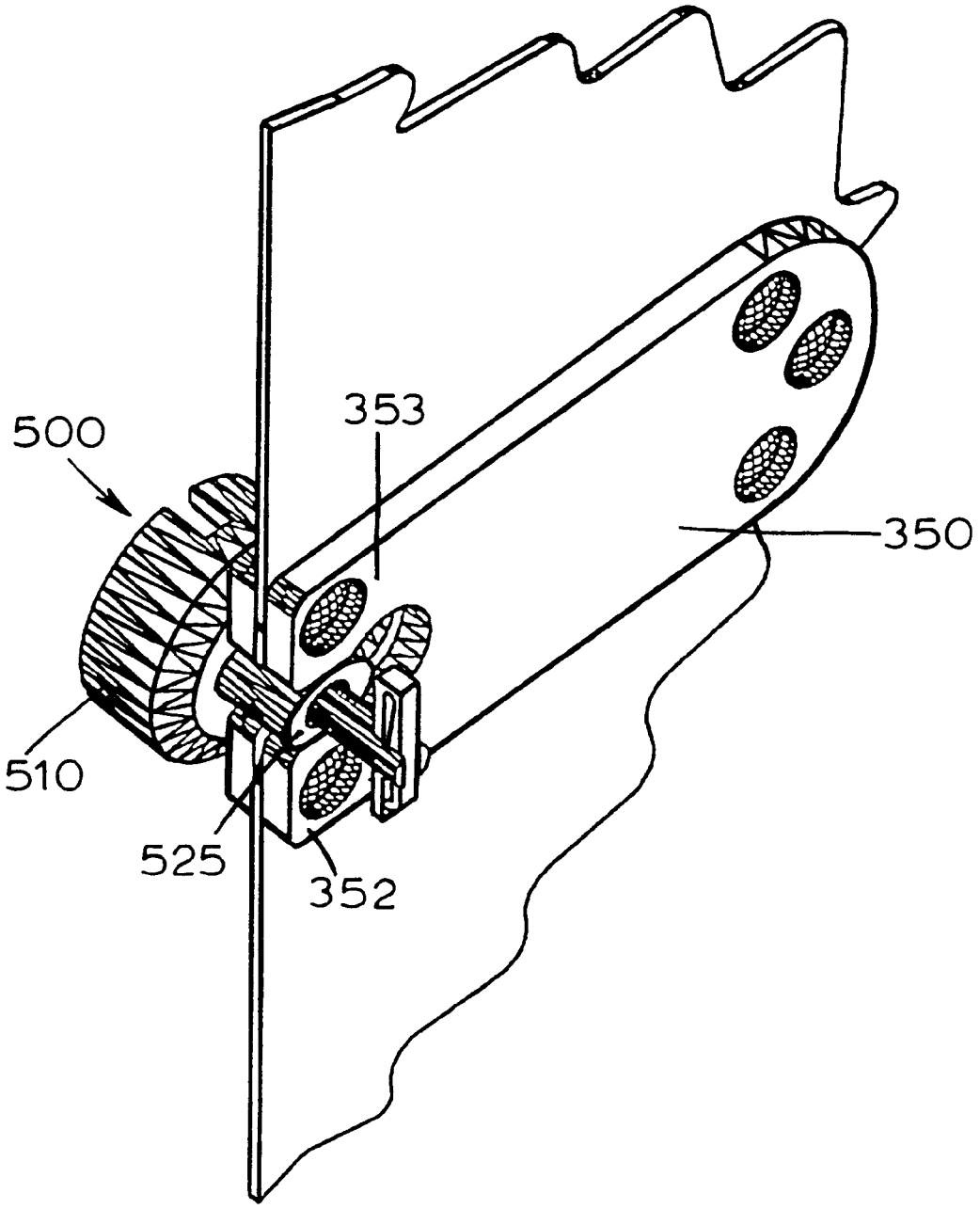
FIG. 12 is a view of the structure of FIG. 11 according to an alternative embodiment.

The separation of the releasable coupling is similar to that described in reference to the releasable coupling at the leading edge of the curtain, and is shown in FIGS. 10 and 11. Under normal operating conditions of the door, the trolley wheels 510 (the second has been removed for clarity) engage the sideframe projections (FIG. 4), as the door moves between its open and closed positions. If wind or other small forces are exerted on the door, the releasable coupling between the trolley 500 and the plate 350 retains the curtain edge in its proper position and orientation. For forces on the curtain above the predetermined magnitude, however, a pulling force tending to separate the plate 350 from the trolley 500 is exerted on the coupling. This force pulls the roller 525 out of the detent 357, and continued movement of the roller 525 in the slot 355 forces the arms 352, 353 apart, eventually allowing release of the trolley and the plate. As mentioned in regard to such a releasable coupling at the leading edge of the door, the post in the form of roller 525 may be modified by allowing the post to deform as well as the arms. The result of forming the post out of such a deformable material is seen in FIG. 12, which shows the post compressed between the arms 352, 353 during separation of the releasable coupling.

Figure 13:
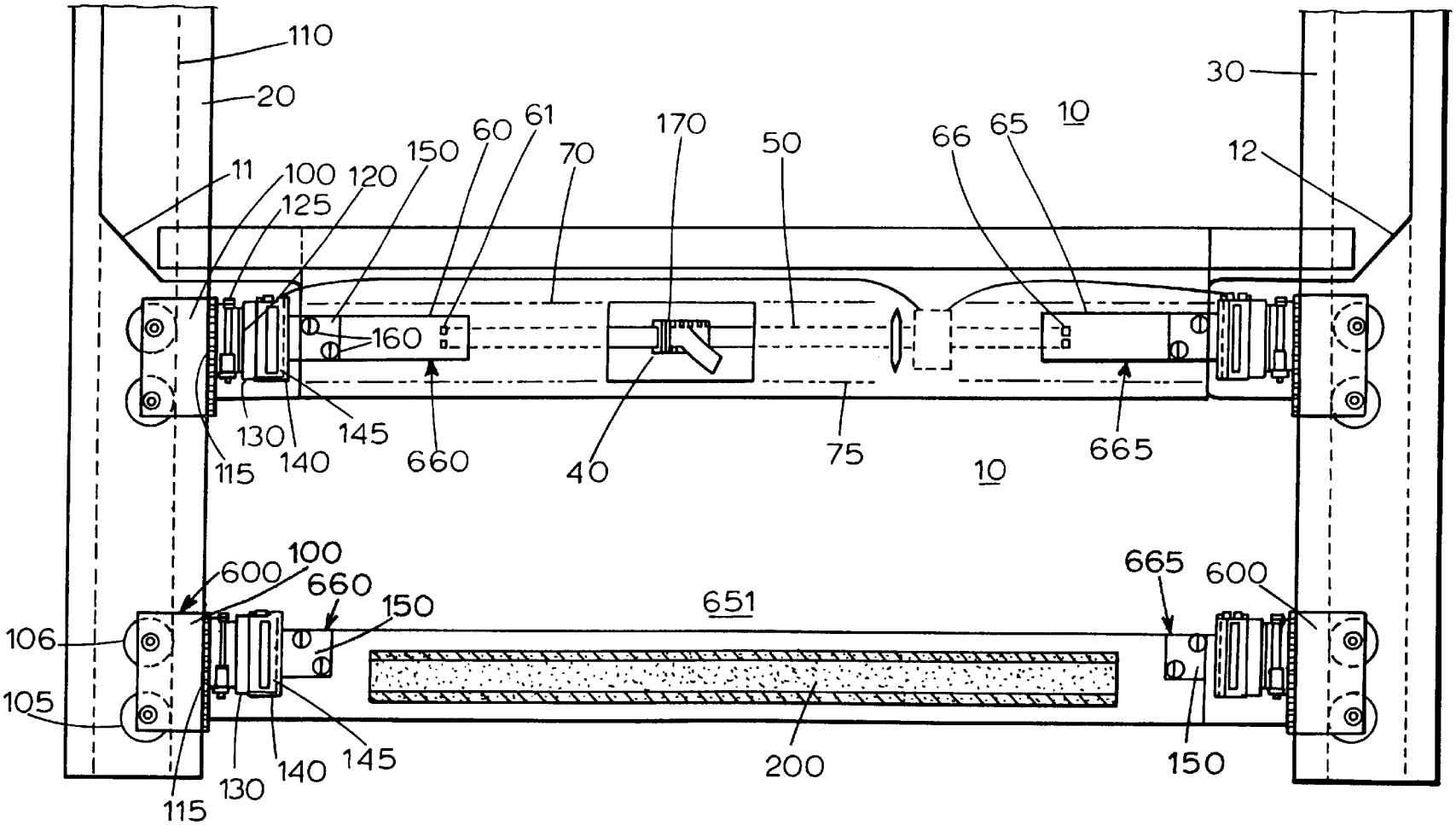
FIG. 13 is an elevational view of a first embodiment of a curtain guiding assembly constructed in accordance with the teachings of the instant invention.

A curtain guiding assembly constructed in accordance with the teachings of the subject invention is depicted in FIG. 13. As the assembly shown in FIG. 13 and the alternative embodiments discussed below employ many of the components discussed above in connection with FIGS. 1–12, in the interest of brevity, the description of those components will not be repeated here. Instead, the interested reader is referred to the foregoing description for a more detailed explanation of the elements common to both the apparatus described below and the apparatus described above. To facilitate this task, whenever possible, like reference numerals are used in the following description to refer to previously described components.

As with the devices described above, the inventive curtain guiding assembly is adapted to assist in guiding a door curtain 10 in blocking and unblocking a doorway. Also like the previous devices, the assembly illustrated in FIG. 13 is adapted to be disposed adjacent a leading edge of a door curtain. As described above, guide members in the form of side frame members 20, 30 are disposed on opposite sides of the doorway.

In order to guide the movement of the door curtain 10, the curtain guiding assembly is provided with a first pair of guide extensions 600. These guide extensions 600 are located on opposite sides of the door adjacent the leading edge of the door curtain 10. As shown in FIG. 13, each of the guide extensions engage an end of a resilient member 651, implemented in this embodiment as a section of the door curtain 10. Each of the guide extensions 600 also engages a respective one of the guide members 20, 30. The guide extensions 600 are restricted from moving toward the center of the curtain 10 by their engagement with the guide members 20, 30. However, the guide extensions 600 do not pre-tension the resilient member 651. Rather, the resilient member 651 only becomes tensioned when subjected to an external force of a sufficient, non-zero magnitude. Such a force will cause deformation of the resilient member 651. By way of example, not limitation, such a force can be generated by wind or by impact between the door curtain 10 and an object.

As shown in FIG. 13, the guide extensions 600 can be implemented by the trolleys 100 described above. Alternatively, the trolleys 400 described above in connection with FIG. 7 can be employed in this role. In any event, each of the guide extensions 600 is preferably implemented to releasably engage an end of the resilient member 651 and to at least partially release from the respective ends of member 651 when the door curtain 10 is subjected to an external force greater than a predetermined threshold. Although a direct connection between the guide extensions 600 and the resilient member 651 is appropriate, in the presently preferred embodiment, these components are releasably coupled via edge members 660, 665. Any release mechanism can be implemented to affect the releasable coupling between the guide extensions 600 and the resilient member 651 including, without limitation, the magnetic side frame inserts discussed above and shown in FIG. 13 and the slotted plate 350 and post 460 assembly described above in connection with FIGS. 6–12. When the FIG. 13 implementation is chosen, the edge members comprise, cup assemblies 140, and ferrous members 145,150. When the implementation illustrated in FIGS. 6–12 is selected, the edge members 660, 665 comprise plates 350. Regardless of the implementation chosen for the release mechanism, the release mechanism is preferably implemented to at least partially release the guide extensions 600 from the resilient member 651 in response to both forces directed into the door curtain 10 and forces directed in the plane of the door curtain 10. In particular, the release mechanism is preferably chosen to release when the curtain is subjected to an external force having a component directed opposite the direction of movement of the door curtain (e.g., a vertical component for a downwardly traveling door in a vertical rectangular doorway) and a magnitude greater than a first predetermined threshold.

The curtain guiding assembly illustrated in FIG. 13 is provided with a resilient member 50 extending across the curtain 10. This member 50 is spaced a distance from the leading edge of the door curtain 10. Thus, while as explained below, the resilient member 50 is under tension to provide various benefits such as wind retention, the resilient member 651 remains substantially untensioned. Preferably, the distance between the resilient member 651 disposed adjacent the leading edge of the curtain and the resilient member 50, is approximately 10¾ inches. However, other distances could also be used without departing from the scope of the invention.

In the embodiment shown in FIG. 13, the resilient member 50 is implemented like the strap 50 described above in connection with FIG. 1. For brevity, that description will not be repeated here. Suffice it to say that the resilient member 50 is coupled to a second pair of guide extensions (implemented in the present embodiment as trolleys 100) which place the resilient member 50 in tension. Those skilled in the art will appreciate, however, that the resilient member 50 could also be implemented as a section of the curtain 10. Similarly, it will be appreciated that although resilient member 651 has been illustrated as comprising a section of the door curtain 10, it could also be implemented as a strap. It will also be appreciated that, if desired, resilient member 50 could be left untensioned but with less slack than resilient member 651 to reduce the amount of wind load experienced by resilient member 651.

Each of the guide extensions in the second pair engage a respective one of the guide members to guide the movement of the curtain 10. As with the first pair of guide extensions 600, the second pair is preferably restricted from moving toward the center of the door curtain 10 and at least one of the extensions 600 in the pair is adapted to at least partially release from its respective resilient member 50 when the door curtain 10 is subjected to an external force greater than a predetermined threshold. In the embodiment shown in FIG. 13, the release mechanism comprises magnetic side frame inserts of the type shown in FIG. 1. However, other release mechanisms could likewise be used in this role, including, without limitation, the slotted plate 350 and post 460 assembly described above, without departing from the scope of the invention. Preferably, all four of the guide extensions in the first and second pairs of guide extensions are adapted for breaking away or releasing from their respective resilient members 50, 651.

From the foregoing, those skilled in the art will appreciate that the leading edge of the door curtain 10 and the first and second resilient members 50, 651 can at least partially conform to or at least partially deflect about encountered obstacles. Thus, the curtain guiding assembly of the present invention enjoys the advantages associated with a soft leading curtain edge. Such advantages were fully explained above in connection with the description of FIGS. 1–12. It also enjoys the advantage of experiencing reduced trolley friction for the trolleys 600 disposed along the leading edge of the curtain 10 as the leading edge of the curtain is not tensioned during normal operation unless the curtain 10 is subjected to an external force.

Figure 14:
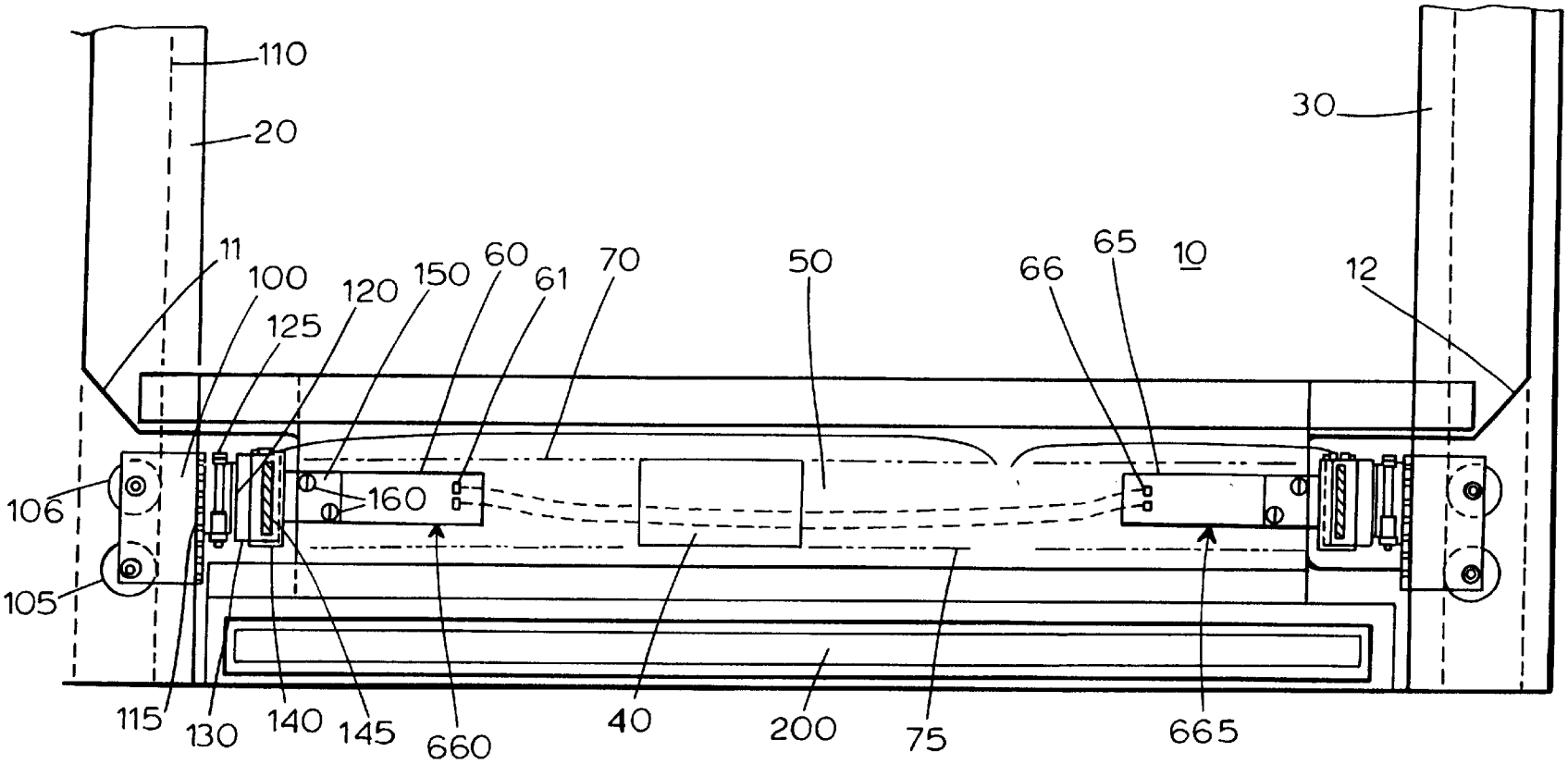
FIG. 14 is an elevational view of a second embodiment of a curtain guiding assembly constructed in accordance with the teachings of the instant invention.

FIG. 14 illustrates another curtain guiding assembly constructed in accordance with the teachings of the present invention. As with the assembly shown in FIG. 13, the assembly of FIG. 14 is disposed adjacent a leading edge of an industrial door for selectively blocking and unblocking a doorway. As in FIG. 13, guide members 20, 30 are located on opposite sides of the doorway. Again like the assembly of FIG. 13, a resilient member 50 is provided; and that member 50 is coupled at either end to a guide extension 100. Although direct connections between the resilient member 50 and the guide extensions 100 are likewise appropriate, in the presently preferred embodiment at least one of the guide extensions 100 (although preferably both), is in cooperative engagement with an edge member 660, 650 coupled to the resilient member. The guide extensions 100 and edge members 660, 650 are preferably releasably coupled to separate when the door curtain is subjected to an external force greater than a predetermined threshold. In FIG. 14, the guide extensions and edge members 660, 650 are respectively implemented by trolley 100 with coupling magnet 130, and by cup assembly 140 with ferrous member 145 and end stiffeners 60, 65. However, other implementations, including, without limitation, the trolley 400 and plate 350 combination described above in connection with FIGS. 6–12 are likewise appropriate.

In accordance with an aspect of the invention, the resilient member 50 of the curtain guiding assembly depicted in FIG. 14 is substantially untensioned when no external force is applied to the door. When an external force having a component directed opposite the direction of movement of the curtain 10 and having a magnitude greater than a predetermined threshold is applied to the door curtain 10, the resilient member 50 will deform and become tensioned. The resilient member 50 returns to its substantially untensioned state upon removal of the external force or upon separation of the guide extension 100 and edge members 660, 665 (e.g., upon application of an external force greater than the predetermined threshold).

As with the assembly described in connection with FIG. 13, the resilient member 50 specifically, and the leading edge of the curtain 10, generally, can at least partially conform to or at least partially deflect about encountered obstacles. Also like the embodiment of FIG. 13, the resilient member 50 may comprise a discrete member or, alternatively, can be a section of the door curtain 10.

For the purpose of distributing wind loads across the door curtain in a predefined manner, the curtain guiding assembly can advantageously be provided with pairs of retention extensions 500 coupled to opposite edges of the curtain. As with the guide extensions 100, 400, 600, each of the retention extensions 500 engage a respective one of the guide members 10,20. Preferably, the retention extensions 500 are adapted to at least partially release from their respective edges when the curtain is subjected to an external force greater than a predetermined magnitude. As with the guide extensions 100, 400, 600 discussed above, the retention extensions 500 are preferably adapted to release from their respective edges of the curtain in response to forces of sufficient magnitude that are directed into the curtain 10, in the plane of the curtain 10, or with components in both of these directions. In any event, each pair of retention extensions preferably tension the curtain 10 therebetween. As above, the retention extensions can be directly coupled to the curtain/resilient member. However, it is presently preferred that edge members be used to form the releasable coupling between the curtain 10 and the retention extensions. The extensions 500 and edge members can be implemented in many different ways without departing from the scope of the invention. By way of example, not limitation, the retention extensions 500 could be implemented by the extensions and edge members illustrated in FIGS. 9–12 above.

In the embodiment illustrated in FIG. 14, a pair of retention extensions 500 such as those shown in FIG. 4 could be advantageously located to reduce the amount of wind load experienced by the guide extensions 100. For example, the retention extensions 500 could be located a distance above the guide extensions 100 such that guide extensions 100 lie between the retention extensions 500 and the leading edge of the curtain 10. By tensioning the section of curtain 10 resilient member that lies between the retention extensions 500, the retention extensions 500 will absorb wind loads that would otherwise be experienced by the untensioned leading edge of the curtain 10 and guide extensions 100. Retention extensions 500, thus, have the advantageous effect of reducing billowing of the untensioned leading edge of the curtain 10 and of preferentially distributing wind load at the leading edge.

When the spacing between the retention extensions 500 and the guide extensions 100 is varied, the amount of force distributed to the retention extensions 500 and guide extensions 100 is likewise changed. Similarly, by providing multiple pairs of retention extensions 500, one can select the spacing between vertically displaced extensions 500 to distribute external forces such as wind and pressure differentials across the curtain in a preferred predetermined manner. For example, the tensioned resilient member (in this embodiment, the curtain section) between the retention extensions 500 could be adapted to separate from the extensions 500 only when subjected to a relatively high breakaway force and the untensioned resilient member (in this embodiment strap 50) disposed between guide extensions 100 could be adapted to break away at a relatively low force without adversely effecting the wind retention characteristics of the door curtain 10. Further, the structures of the extensions 100, 400, 500, 600 can be varied as described above, and/or their distribution with respect to the curtain 10 can be selected, such that all of the extensions 100, 400, 500, 600 release their respective edge members at substantially the same time when subjected to a force of sufficient magnitude.

Figure 15:
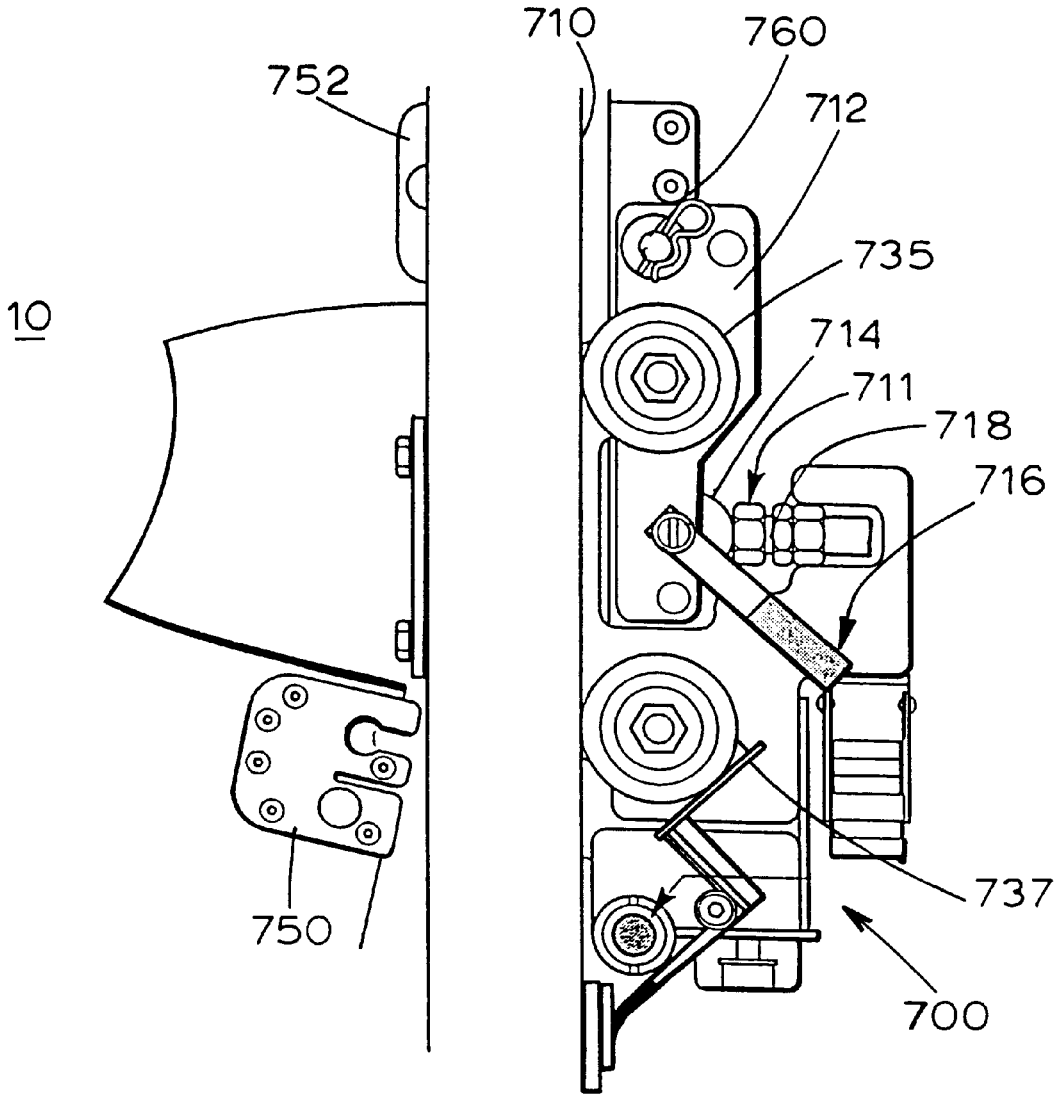
FIG. 15 is an elevational view of a third embodiment of a curtain guiding assembly constructed in accordance with the teachings of the instant invention.
Figure 16:
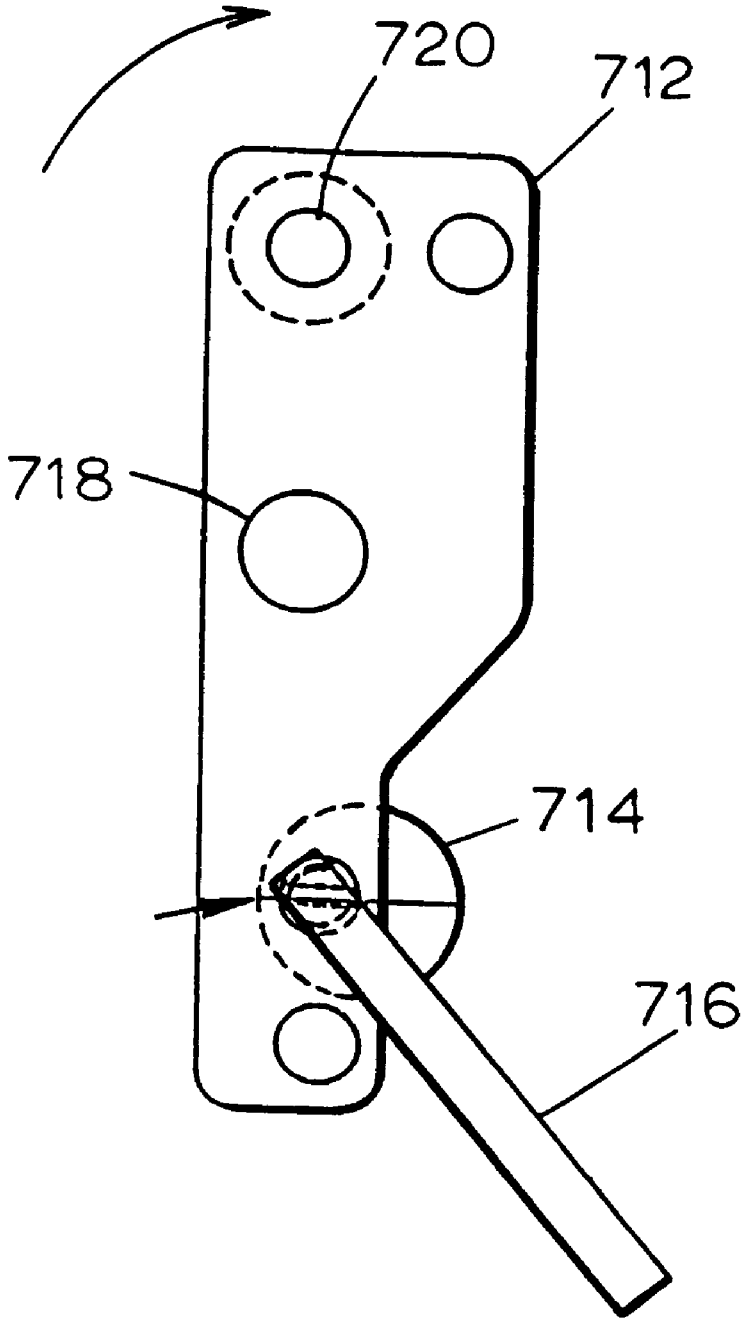
FIG. 16 is a schematic view of the tensioning lever of the assembly of FIG. 15.

An alternative embodiment of a curtain guiding assembly is shown in FIGS. 15 and 16. In this embodiment, the curtain 10 comprises the resilient member 50, and the assembly is provided with a pair of trolleys 700 designed for releasably coupling with edge members implemented as plates 750, 752 in the manner described in connection with FIGS. 6–8. However, in the embodiment shown in FIGS. 15 and 16, each trolley 700 is provided with two wheels 735, 737 and a tensioning mechanism 711. The tensioning mechanisms 711 of the trolleys 700 permit the curtain guiding assembly to tension the section of curtain 10 disposed immediately above the upper wheels 735 without tensioning the section of curtain 10 between the lower trolley wheels 737. Of course, as with the earlier described embodiments, the leading edge of the curtain 10 and the resilient member (e.g., the section of curtain 10 disposed immediately above the upper trolley wheels 735) are adapted to at least partially conform to and at least partially deflect about encountered obstacles.

As shown in FIGS. 15 and 16, the tensioning mechanism 711 of the illustrated embodiment comprises a support plate 712, an eccentric 714 journalled in the support plate 712 for rotational movement, a lever 716 for rotating the eccentric 714, and a cam adjusting bolt 718. As shown in FIG. 15, the axle of the upper wheel 735 is rotatably mounted within an aperture 719 defined in the support plate 712. Thus, the axle of the upper wheel 735 couples the support plate 712 to the trolley 700. The support plate 712 is further provided with a second aperture 720 for receiving the post 760 which releasably couples the trolley 700 to the upper plate 750.

As shown in FIG. 15, the wheels 735, 737 of the trolley 700 are located to ride along a surface 710 on the guide member. When the lever 716 is pivoted downwards, eccentric 714 will rotate such that plate 712 pivots in a clockwise direction about an axis of rotation defined by the axle of the upper trolley wheel 735. This clockwise rotation has the effect of pulling aperture 720 and, thus, post 760 of the breakaway or release mechanism away from the doorway thereby bringing the section of curtain 10 disposed above the upper wheels 735 under tension. As those skilled in the art will appreciate, because the upper trolley wheels 735 are located against surface 710, trolley wheels 735 remain substantially stationary during this tensioning process. Thus, the section of curtain 10 that experiences the tension is the area immediately above the upper trolley wheels 735. As those skilled in the art will further appreciate, the sections of curtain 10 between and below wheels 735 will experience little or no tensioning when the tensioning lever 716 is pivoted.

In the presently preferred embodiment, cam adjusting bolt 718, which abuts eccentric 714, can be screwingly adjusted to ensure trolley wheel 735 contacts surface 710 and to provide an abutment which ensures plate 712 pivots in an appropriate direction when lever 716 is pivoted. Those skilled in the art will appreciate that, although plate 712 has been described as pivoting in a clockwise direction, the plate 712 will preferably pivot in the opposite sense for tensioning assemblies located on the side of curtain 10 opposite that shown in FIG. 15. Those skilled in the art will further appreciate that the rotational directions can be reversed such that the area of curtain 10 immediately below the upper trolley wheel 735 becomes tensioned without departing from the scope or spirit of the invention.

The alternative embodiment illustrated in FIGS. 15 and 16 can be utilized in several different fashions without departing from the scope of the invention. For example, the illustrated assembly could be positioned at or near the leading edge of the curtain 10. In such an approach, the assembly could be arranged such that the section of curtain 10 beneath the lower wheel 737 is untensioned unless subjected to an external force whereas the section of curtain 10 immediately above the upper wheel 735 is tensioned to act as a wind retention bar.

Those skilled in the art will appreciate that exemplary embodiments illustrated in FIGS. 13–16 are shown by way of example, not limitation. For example, any of these embodiments can be combined with additional features and components of the structures illustrated in FIGS. 1–12 without departing from the scope of the invention. By way of example, in any of the foregoing embodiments, the resilient member could be implemented as a strap of webbed belting material, a braided belt, or as the curtain itself. Also, the resilient member could be disposed within a pocket formed by a flap of material fixed to the door curtain as described above. Further, like the apparatus described above in connection with FIGS. 1–12, the curtain guiding assemblies of the present invention are preferably used in conjunction with ballast tubes 200 filled with compressible material. Further, those skilled in the art will appreciate that, since the resilient members employed in any of the foregoing embodiments are resiliently flexible, they can be deformed in any direction, and particularly in a vertical direction (for a vertically disposed door), by an applied force and will still return to their original shape or position upon removal of the force.

Further, those skilled in the art will appreciate that, as used herein "guide extension" is not meant to require that the corresponding structure extends beyond the edge of the curtain or beyond the associated guide member.

Any of the various embodiments of the invention, which can be envisioned by one skilled in the art, can at least partially conform to or deflect around encountered obstacles, while still giving the curtain advantageous functional features typically associated with a rigid bottom bar, including wind retention. Since a door employing a curtain guiding assembly constructed according to the teachings of the invention substantially conforms to or deflects around any obstructions which it may encounter, the need for sensors to sense such obstructions, and to signal the need for stopping or reversal of the door, is eliminated. The invention also encompasses providing a releasable coupling between the curtain and the guide extensions. Thus, for encountered obstacles or impacts, the curtain may substantially conform or deflect, or it may separate from the guide extensions, depending on the magnitude of force exerted on the curtain Other advantages of the invention will be apparent to those skilled in the art.

What is claimed is:

1. For use with an industrial door for selectively blocking and unblocking a doorway having guide members disposed on opposite sides thereof, an assembly comprising in combination:

a first resilient member disposed adjacent a leading edge of a door curtain, the first resilient member being substantially untensioned when no external force is applied to the door curtain and being adapted to at least partially conform to or at least partially deflect about encountered obstacles; and guide extensions coupled to either end of the first resilient member, each of the guide extensions being adapted to engage a respective one of the guide members to guide the movement of the door curtain;

wherein the first resilient member becomes tensioned upon application of an external force directed opposite a direction of movement of the door curtain and in a plane of the door curtain and of a magnitude greater than a first predetermined threshold.

2. An assembly as defined in claim 1 wherein the first resilient member returns to its substantially untensioned state upon removal of the external force.

3. An assembly as defined in claim 1 wherein the first resilient member is deformable in the direction of the component of the applied force.

4. An assembly as defined in claim 1 wherein at least one of the guide extensions is coupled to the first resilient member to at least partially release when the door curtain is subjected to an external force having a component directed opposite the direction of movement of the door curtain and a magnitude greater than a second predetermined threshold.

5. An assembly as defined in claim 4 wherein the first resilient member returns to its substantially untensioned state upon removal of the external force or after the first resilient member and the at least one guide extension have released in response to application of an external force greater than the second predetermined threshold.

6. An assembly as defined in claim 4 further comprising an edge member coupled to the first resilient member and to the at least one guide extension to form a releasable coupling therebetween.

7. An assembly as defined in claim 4 wherein the second predetermined threshold is greater than the first predetermined threshold.

8. An assembly as defined in claim 1 further comprising a first pair of retention extensions, each of the retention extensions being located on an opposite edge of the door curtain and being coupled to an opposite end of a second resilient member, each of the retention extensions in the first pair being adapted to engage a respective one of the guide members, at least one of the first pair of retention extensions being adapted to at least partially release from the second resilient member when the door curtain is subjected to an external force having a magnitude greater than a third predetermined threshold.

9. An assembly as defined in claim 8 wherein the first pair of retention extensions pre-tension the second resilient member therebetween to reduce the amount of wind load experienced by the guide extensions.

10. An assembly as defined in claim 8 further comprising a second pair of retention extensions located a distance away from the first pair of retention extensions, each of the retention extensions in the second pair being adapted to engage a respective one of the guide members and a respective end of a third resilient member disposed across the door curtain, at least one of the second pair of retention extensions being adapted to at least partially release from the third resilient member when the door curtain is subjected to an external force having a magnitude greater than a fourth predetermined threshold.

11. An assembly as defined in claim 10 wherein the third predetermined threshold is substantially equal to the fourth predetermined threshold.

12. An assembly as defined in claim 10 wherein the first and second pairs of retention extensions and the guide extensions are located to distribute wind loads across the door curtain in a predetermined manner.

13. An assembly as defined in claim 12 wherein one of the guide extensions is releasably coupled to the first resilient member to at least partially release when the door curtain is subjected to an external force having a component directed opposite the direction of movement of the door curtain and a magnitude greater than a second predetermined threshold.

14. An assembly as defined in claim 13 wherein the at least one of the first and second pairs of retention extensions are adapted to at least partially release from the second and third resilient members and the guide extension is adapted to at least partially release from the first resilient member at substantially the same time when subjected to an external force of sufficient magnitude.

15. An assembly as defined in claim 8 further comprising a first retention edge member coupled to the second resilient member and to the at least one of the first pair of retention extensions to form a releasable coupling therebetween.

16. An assembly as defined in claim 10 further comprising a second retention edge member coupled to the third resilient member and to the at least one of the second pair of retention extensions to form a releasable coupling therebetween.

17. An assembly as defined in claim 8 wherein the second resilient member comprises a section of the door curtain.

18. An assembly as defined in claim 10 wherein the third resilient member comprises a section of the door curtain.

19. An assembly as defined in claim 4 wherein the guide extension and the first resilient member release when an external force having a magnitude greater than the second predetermined threshold is applied to the door curtain in any direction.

20. An assembly as defined in claim 1 where in the first resilient member comprises a strap of belting material.

21. An assembly as defined in claim 1 wherein the first resilient member comprises a section of the door curtain.

22. For use with an industrial door for selectively blocking and unblocking a doorway having guide members disposed on opposite sides thereof, an assembly comprising, in combination:

a first resilient member disposed adjacent the leading edge of a door curtain;

a first pair of guide extensions located on opposite sides of the door curtain adjacent the leading edge thereof, each of the guide extensions in the first pair engaging a respective end of the first resilient member without pretensioning the first resilient member, each of the guide extensions in the first pair being adapted to engage a respective one of the guide members to guide the movement of the door curtain;

a second resilient member extending across the door curtain and spaced a distance from the first resilient member; and a second pair of guide extensions coupled to either end of the second resilient member and being adapted to engage a respective one of the guide members to guide the movement of the door curtain, the second pair of guide extensions being restricted from moving toward the center of the door curtain, the second pair of guide extensions pretensioning the second resilient member therebetween; wherein the leading edge of the door curtain and the first and second resilient members can at least partially conform to or at least partially deflect about encountered obstacles.

23. An assembly as defined in claim 22 wherein the first and second resilient members are deformable in any direction.

24. An assembly as defined in claim 22 wherein at least one of the guide extensions in the second pair is coupled to at least partially release from the second resilient member when the door curtain is subjected to an external force having a magnitude greater than a first predetermined threshold.

25. An assembly as defined in claim 24 further comprising an edge member coupled to the second resilient member and to the at least one of the guide extensions in the second pair to form a releasable coupling therebetween.

26. An assembly as defined in claim 24 wherein at least one of the guide extensions in the first pair is coupled to at least partially release from the first resilient member when the door curtain is subjected to an external force having a magnitude greater than a second predetermined threshold.

27. An assembly as defined in claim 26 further comprising an edge member coupled to the first resilient member and to the at least one of the guide extensions in the first pair to form a releasable coupling therebetween.

28. An assembly as defined in claim 22 wherein the first resilient member comprises a section of the door curtain.

29. An assembly as defined in claim 22 wherein the second resilient member comprises a strap of belting material.

30. An assembly as defined in claim 22 wherein the second resilient member comprises a section of the door curtain.

31. For use with an industrial door for selectively blocking and unblocking a doorway having guide members disposed on opposite sides thereof, an assembly comprising, in combination:

a first resilient member;

a first guide extension being adapted to cooperatively engage a first one of the guide members, the first guide extension being detachably coupled to the first resilient member to at least partially release when the first resilient member is subjected to an external force greater than a first predetermined threshold;

a second guide extension being adapted to cooperatively engage a second one of the guide members, the second guide extension being coupled to the first resilient member;

wherein the first resilient member experiences substantially zero tension when no external force is applied, experiences a first non-zero tension when an external force less than the first predetermined threshold is applied, and experiences a second substantially zero tension after an external force greater than the first predetermined threshold is applied;

a second resilient member;

a third guide extension being adapted to cooperatively engage a first one of the guide members, the third guide extension being detachably coupled to the second resilient member to at least partially release when the second resilient member is subjected to an external force greater than a second predetermined threshold;

a fourth guide extension being adapted to cooperatively engage a second one of the guide members, the fourth guide extension being coupled to the second resilient member;

wherein the second resilient member experiences a third non-zero tension when no external force is applied, experiences a fourth non-zero tension greater than the third non-zero tension when an external force less than the second predetermined threshold is applied, and experiences a fifth substantially zero tension when an external force greater than the second predetermined threshold is applied.

32. An assembly as defined in claim 31 wherein the second substantially zero tension is zero.

33. An assembly as defined in claim 31 wherein the first guide extension and the first resilient member at least partially release when an external force greater than the first predetermined threshold is applied either into the curtain or in the plane of the curtain.

34. A curtain guiding assembly for guiding an industrial door for selectively opening and closing a doorway defined by oppositely disposed guide members, the curtain guiding assembly comprising:

a resilient member;

a first trolley located at a first edge of the door curtain and adapted to engage a first one of the guide members, one end of the resilient member being secured to the first trolley;

a second trolley disposed at a second edge opposite the first edge of the door curtain and adapted to engage a second one of the guide members, the second trolley having a first wheel;

a tensioning member associated with the first wheel of the second trolley;

means for releasably coupling the resilient member to the tensioning member; and an eccentric and a lever cooperating with the eccentric for moving the tensioning member to tension the resilient member between the first and second trolleys.

35. A curtain guiding assembly as defined in claim 34 wherein the resilient member comprises the door curtain.

36. A curtain guiding assembly as defined in claim 34 wherein the resilient member acts as a wind retention bar.

37. A curtain guiding assembly as defined in claim 34 wherein the resilient member is adapted to at least partially conform to or at least partially deflect about encountered obstacles. external force or when the releasably coupling means releases the resilient member from the pivotable member.

38. A curtain guiding assembly as defined in claim 34 wherein a section of the door curtain disposed between the first trolley and the second trolley is substantially untensioned when no external force is applied to the door curtain.

39. A curtain guiding assembly as defined in claim 38 wherein the substantially untensioned section of the door curtain disposed between the first trolley and the second trolley becomes tensioned upon application of an external force less than a first predetermined threshold and returns to its untensioned state upon removal of the external force or when the releasably coupling means releases the resilient member from the tensioning member.

40. A curtain guiding assembly as defined in claim 34 wherein the coupling means releases the resilient member when the curtain is subjected to an external force having a magnitude greater than a predetermined threshold.

41. A curtain guiding assembly as defined in claim 34 wherein the eccentric and lever cooperate to pivot the tensioning member.

42. For use with an industrial door for selectively blocking and unblocking a doorway having guide members disposed on opposite sides thereof, an assembly comprising, in combination:

a first resilient member disposed adjacent a leading edge of a door curtain, the first resilient member being substantially untensioned when no external force is applied to the door curtain and being adapted to at least partially conform to or at least partially deflect about encountered obstacles;

guide extensions coupled to either end of the first resilient member, each of the guide extensions being adapted to engage a respective one of the guide members to guide the movement of the door curtain;

a second resilient member; and a first pair of retention extensions, each of the retention extensions being located on an opposite edge of the door curtain and being coupled to an opposite end of the second resilient member, each of the retention extensions in the first pair being adapted to engage a respective one of the guide members to pretension the second resilient member;

wherein the first resilient member becomes tensioned upon application of an external force having a component directed opposite a direction of movement of the door curtain and in a plane of the door curtain and of a magnitude greater than a first predetermined threshold.

43. A curtain guiding assembly for guiding an industrial door for selectively opening and closing a doorway defined by oppositely disposed guide members, the curtain guiding assembly comprising:

a resilient member;

a first trolley located at a first edge of the door curtain and adapted to engage a first one of the guide members, one end of the resilient member being secured to the first trolley;

a second trolley disposed at a second edge opposite the first edge of the door curtain and adapted to engage a second one of the guide members, the second trolley having a first wheel with an axis;

a tensioning member mounted for pivoting movement about the axis of the first wheel and being releasably coupled to the resilient member; and a lever for pivoting the tensioning member to tension the resilient member between the first and second trolleys.

44. A curtain guiding assembly as defined in claim 43 wherein the resilient member comprises the door curtain.

45. A curtain guiding assembly as defined in claim 43 wherein the resilient member acts as a wind retention bar.

46. A curtain guiding assembly as defined in claim 43 wherein the resilient member is adapted to at least partially conform to or at least partially deflect about encountered obstacles.

47. A curtain guiding assembly as defined in claim 43 wherein a section of the door curtain disposed between the first trolley and the second trolley is substantially untensioned when no external force is applied to the door curtain and when the tensioning member tensions the resilient member.

48. A curtain guiding assembly as defined in claim 47 wherein the substantially untensioned section of the door curtain disposed between the first trolley and the second trolley becomes tensioned upon application of an external force less than a first predetermined threshold and returns to its untensioned state upon removal of the external force or when the resilient member releases from the tensioning member.

49. A curtain guiding assembly as defined in claim 43 further comprising an eccentric cooperating with the lever to pivot the tensioning member.

50. A curtain guiding assembly as defined in claim 43 wherein the tensioning member releases the resilient member when the curtain is subjected to an external force having a magnitude greater than a predetermined threshold.

51. An assembly as defined in claim 31 wherein the fifth substantially zero tension is zero.

52. An assembly as defined in claim 31 wherein the second guide extension and the second resilient member at least partially release when an external force greater than the second predetermined threshold is applied either into the curtain or in the plane of the curtain.

* * * * *